US005600355A

United States Patent [19]

Wada

[11] Patent Number: 5,600,355

[45] Date of Patent: Feb. 4, 1997

[54] COLOR IMAGE FORMING APPARATUS BY DIRECT PRINTING METHOD WITH FLYING TONER

[75] Inventor: Takasumi Wada, Nara, Japan

[73] Assignee: Sharp Kabushiki Kaisha, Osaka, Japan

[21] Appl. No.: 550,827

[22] Filed: Oct. 31, 1995

[30] Foreign Application Priority Data

Nov. 4, 1994 [JP] Japan ..... 6-271552

[51] Int. Cl.[6] ..... G03G 15/00; G03G 15/01

[52] U.S. Cl. ..... 347/55; 347/115

[58] Field of Search ..... 347/56, 115, 158, 347/117; 395/116

[56] References Cited

U.S. PATENT DOCUMENTS

| | | | |
|---|---|---|---|
| 4,568,955 | 2/1986 | Hosoya et al. | 347/55 |
| 5,170,185 | 12/1992 | Takemura et al. | 347/55 |
| 5,283,594 | 2/1994 | Iwao | 347/55 |
| 5,305,026 | 4/1994 | Kazuo et al. | 347/55 |
| 5,353,050 | 10/1994 | Kagayama | 347/55 |
| 5,357,274 | 10/1994 | Kitamura | 347/55 |
| 5,374,949 | 12/1994 | Wada et al. | 347/112 |
| 5,471,322 | 11/1995 | Murata | 395/116 X |
| 5,477,250 | 12/1995 | Larson | 347/55 |

FOREIGN PATENT DOCUMENTS

| | | |
|---|---|---|
| 0488652 | 6/1992 | European Pat. Off. . |
| 4-191780 | 7/1992 | Japan . |
| 4-216963 | 8/1992 | Japan . |
| 4-268591 | 9/1992 | Japan . |
| 6-234233 | 8/1994 | Japan . |

*Primary Examiner*—Joan H. Pendegrass
*Assistant Examiner*—Sophia S. Chen
*Attorney, Agent, or Firm*—David G. Conlin; William J. Daley, Jr.

[57] ABSTRACT

A color image forming apparatus includes development rollers, aligned in the transport direction of recording paper, for carrying toner of respective colors charged in a predetermined polarity. A driver substrate having a plurality of toner passing holes in locations facing the development rollers is installed. Control electrodes are mounted around the toner passing holes. A back electrode is mounted opposite to the driver substrate so that the recording paper passes through a section between the back electrode and the driver substrate. A voltage whose polarity is opposite to the toner is applied to the back electrode, while either a first voltage or a second voltage is selectively applied to the control electrode according to an image signal. The first voltage allows the passage of toner through the toner passing holes. The second voltage prevents the passage of the toner. Both the first and second voltages to be applied to the control electrode have the same polarity as the toner. This structure prevents adhesion of the toner to the control electrode, thereby obtaining a quality image.

31 Claims, 18 Drawing Sheets

COLOR IMAGE FORMING APPARATUS BY DIRECT PRINTING METHOD WITH FLYING TONER

FIELD OF THE INVENTION

The present invention relates to a color image forming apparatus for reproducing character and image signals output from image information output devices, such as a computer, word processor and facsimile machine, as a visible image on a recording material.

BACKGROUND OF THE INVENTION

The following apparatuses are known as apparatuses for forming a visible image on a recording material such as paper based on electric signals output from image information output devices, for example, a computer, word processor and facsimile machine. Namely, an image forming apparatus employing an ink jet method in which ink is used, an image forming apparatus employing a heat transfer method in which ink is fused and transferred, an image forming apparatus using a method of sublimating ink, and an image forming apparatus using an electrophotographic method.

Among these apparatuses, in recent years, the ink jet method which is a non-impact method and performed with a relatively simplified structure including an integrated printer head has been frequently employed to meet demands for an improvement of image quality, an increase in the printing speed and a reduction in cost. However, with the ink jet method, since ink in liquid form is used, recording paper tends to have ink blots which prevent the formation of quality images. Moreover, when different colors are superimposed in color printing, it is difficult to perform good mixed-color development by mixing inks of different colors. Therefore, when high-quality images are desired, the electrophotographic method which performs printing with toner is adopted.

In printing using toner, not only visually excellent strong color images without ink blots are obtained, but also satisfactory mixed colors are obtained because mixing of a plurality of colors is performed in the fixing process of color imaging. Then, a direct printing method has been proposed. This is a combination of a simplified process of the ink jet method and an imaging method using a toner, and performs direct printing by flying the toner.

For example, Japanese Publication for Unexamined Patent Application 191780/1992 (Tokukaihei 4-191780) as a first prior art discloses a structure including a substrate having a plurality of toner passing holes for controlling the passage of toner according to image signals and toner supply means which is provided in the holes only when performing imaging so as to prevent the toner passing holes from being clogged with the toner.

Japanese Publication for Unexamined Patent Application 216963/1992 (Tokukaihei 4-216963) as a second prior art discloses a technique for forming color images on a recording material by a structure including a substrate having a toner passing hole for controlling the passage of toner according to image signals and a plurality of toner tanks which are sequentially moved to the toner passing hole so as to prevent the toner passing hole from being clogged with the toner.

Japanese Publication for Unexamined Patent Application 268591/1992 (Tokukaihei 4-268591) as a third prior art discloses a structure which includes toner tanks for storing toners of different colors disposed in parallel on a transport path of a recording material and a substrate having a toner passing hole in each toner tank, and controls the passage of toner through the toner passing hole according to image signals.

Japanese Publication for Unexamined Patent Application 234233/1994 (Tokukaihei 6-234233) as a fourth prior art discloses a structure which includes toner tanks for storing toners of different colors disposed in parallel on a transport path of a recording material and toner passing holes formed on a common substrate facing the toner tanks so as to correspond to the respective toner tanks, and controls the passage of toner through the toner passing holes according to image signals.

However, with the first and second prior arts, since a control electrode provided in the toner passing hole and the toner tank move with respect to each other, it is difficult to place them in correct positions with accuracy when forming an image. Moreover, since means for performing relative movements of the toner passing hole and the toner tank is required, the structure becomes complicated and the cost is increased.

With the third and fourth prior arts, since the toner tanks for different toner colors are fixed, the above-mentioned problem is solved. However, the first to fourth prior arts including the first and second prior arts do not much consider an improvement of the image quality, for example, the production of quality images by stabilizing an electric potential around the control electrode by reducing the influence of toner, or the production of a vivid color image by forming dots with toner in correct positions.

SUMMARY OF THE INVENTION

It is an object of the present invention to provide a color image forming apparatus capable of improving image quality.

In order to achieve the above object, a color image forming apparatus of the present invention includes:

(a) toner carriers, aligned in a transport direction of recording paper in a recording paper passing section, for carrying toner charged in a predetermined polarity, one toner carrier being provided for each toner color;

(b) an insulating substrate including a plurality of toner passing holes having a diameter which allows the passage of the toner, the insulating substrate being disposed opposite to the toner carriers, the toner passing holes being formed in locations facing the toner carriers;

(c) control electrodes mounted on positions corresponding to the toner passing holes, respectively, on the insulating substrate;

(d) back electrodes disposed opposite to the insulating substrate with a clearance therebetween, the clearance functioning as the recording paper passing section;

(e) recording paper transporting means for transporting the recording paper through the recording paper passing section;

(f) back-electrode voltage applying means for applying to the back electrodes a voltage of the opposite polarity to the toner to produce an electric field which causes the toner carried by the toner carriers to pass through the toner passing holes and move toward the back electrodes; and (g) control-electrode voltage applying means for producing an electric field which controls the movement of the toner from the toner carriers toward the back electrodes through the toner passing holes by selectively applying to the control electrodes a voltage of the same polarity as the toner according to an image signal.

In this structure, when a voltage of the opposite polarity to the toner is applied to the back electrodes by the back-electrode voltage applying means, an electric field for moving the toner from the toner carriers through the toner passing holes toward the back electrodes is produced. As a result, the toner carried on the toner carriers moves toward the back electrode because of this electric field. Then, if a voltage corresponding to an image signal is selectively applied to each control electrode by the control-electrode voltage applying means, the passage of toner through the toner passing holes corresponding to the control electrodes is allowed or prevented according to the image signal, thereby producing a toner image corresponding to the image signal on the recording paper transported through the recording paper passing section.

Both the voltages applied to the control electrode by the control-electrode voltage applying means for allowing and preventing the passage of the toner through the toner passing holes are of the same polarity as the toner. It is therefore possible to prevent the toner from adhering to the control electrodes and the connecting wire for supplying power to the control electrodes in either case when the passage of the toner is allowed, i.e., during printing, or when the passage of the toner is prevented, i.e., during non-printing. This structure prevents the toner accumulated on the control electrodes or the connecting wire from falling on the recording paper and making the recording paper dirty, the toner passing holes from being clogged with the toner, and the print quality from deteriorating due to the instability of an electric field around the control electrodes caused by the accumulated toner. It is thus possible to obtain a high-quality image.

Moreover, it is desirable to arrange the voltage for moving the toner through the toner passing holes toward the back electrode to be adjustable among the voltages applied to the control electrodes by the control-electrode voltage applying means. This arrangement enables adjustment of the amount of toner and the toner adhesive area of the recording paper when printing an image on the recording paper. As a result, the density and diameter of dots of each color to be printed on the recording paper become adjustable, thereby reproducing a quality image.

It is also desirable to design the structure so that the toner passing holes are arranged at substantially equal intervals in a direction orthogonal to the transport direction of the recording paper and in rows parallel to the transport direction of the recording paper with respect to each color, and the control electrodes of respective colors which are installed on the periphery of the toner passing holes of the respective colors producing one pixel aligned in the transport direction of the recording paper, are electrically connected to each other.

With this structure, if the control electrodes corresponding to respective colors and the back electrodes corresponding to the respective colors are controlled in matrix, it is possible to print toner of a plurality of colors by the circuit for driving the number of control electrodes corresponding to one color without using a circuit for separately driving the control electrodes of the respective color. Consequently, a high-quality color image can be obtained with a simplified structure.

Furthermore, it is desirable to design the structure so that the diameter of each toner passing hole is set according to the color of toner carried by the toner carrier to which the toner passing hole belongs, and at least one of the control-electrode voltage applying means and the back-electrode voltage applying means sets an output voltage according to the diameter of the toner passing hole. This structure enables the reproduction of a quality color image.

More specifically, by determining the diameter of the toner passing hole according to the color of toner, for example, by arranging the toner passing hole corresponding to the toner of yellow color which is relatively soft color to have a relatively large diameter, the amounts of toner of the respective colors passing through the toner passing holes become adjustable with respect to each other. Additionally, if at least either the voltage to be applied to the control electrode or the voltage to be applied to the back electrode is determined according to the diameter of the toner passing hole, it is possible to suitably control the amount of toner to pass through the toner passing holes and reproduce a quality color image.

The control-electrode voltage applying means includes:

(h) control signal generating means for generating a control signal corresponding to each control electrode from an image signal; and (i) signal converting means for converting a control signal output by the control signal generating means into a predetermined control voltage. The control-electrode voltage applying means is preferably mounted on the insulating substrate.

With this structure, it is possible to concentrate on the insulating substrate the high-voltage circuits for supplying a voltage to the control electrodes. Thus, the high-voltage circuits are separated from other control circuits as low-voltage circuits of the color image forming apparatus, preventing the high-voltage circuits from affecting the low-voltage circuits. As a result, faulty operations and defects of the apparatus are reduced, thereby improving the reliability of the apparatus.

It is desirable to form a semiconducting layer on the top surface of the back electrode. This arrangement prevents charges from being produced on the surface of the back electrode by the friction when the transported recording paper slides on the back electrode, the charges from obstructing the transport of the recording paper, and the discharge from the back electrode to which a high voltage has been applied.

The color image forming apparatus of the present invention, further includes (j) fusing means, disposed on a downstream side of the control electrode located in the most downstream position in the transport direction of the recording paper, for heating the toner on the recording paper so as to fix the toner to the recording paper, wherein the length of a recording paper transport path between the fusing means and the control electrode located on the most downstream position is set longer than a length of the recording paper in the transport direction, and the recording paper transporting means is capable of stopping the recording paper in the recording paper passing section.

In this structure, it is possible to perform printing on the recording paper while suitably stopping the recording paper. Thus, printing can be performed by successively transferring less image signals compared to the structure in which printing is performed by continuously moving the recording paper. As a result, the capacity of each memory means disposed on the transmission path of the image signals is decreased, thereby lowering the cost. In this case, since the recording paper can never be nipped by the fusing means, it is possible to avoid the recording paper from being heated when stopped in printing. Consequently, the recording paper can never be deformed, discolored or creased by the heat.

In addition, with respect to a plurality of toner passing holes formed on the insulating substrate, it is desirable that the positions of toner passing holes belonging to one of the toner carriers and the positions of the toner passing holes belonging to the other toner carriers differ from each other at least in a direction orthogonal to the transport direction of the recording paper. In this case, at least a group of dots of different colors is formed on the recording paper without overlapping each other. It is therefore possible to obtain a clearer image without turbidity compared to a color image formed by superimposing dots of different colors. Thus, an improvement of the image quality is achieved.

For a fuller understanding of the nature and advantages of the invention, reference should be made to the ensuing detailed description taken in conjunction with the accompanying drawings.

DESCRIPTION OF THE PREFERRED EMBODIMENTS

The following description discusses one embodiment of the present invention with reference to FIGS. 1 to 23.

Figure 2:
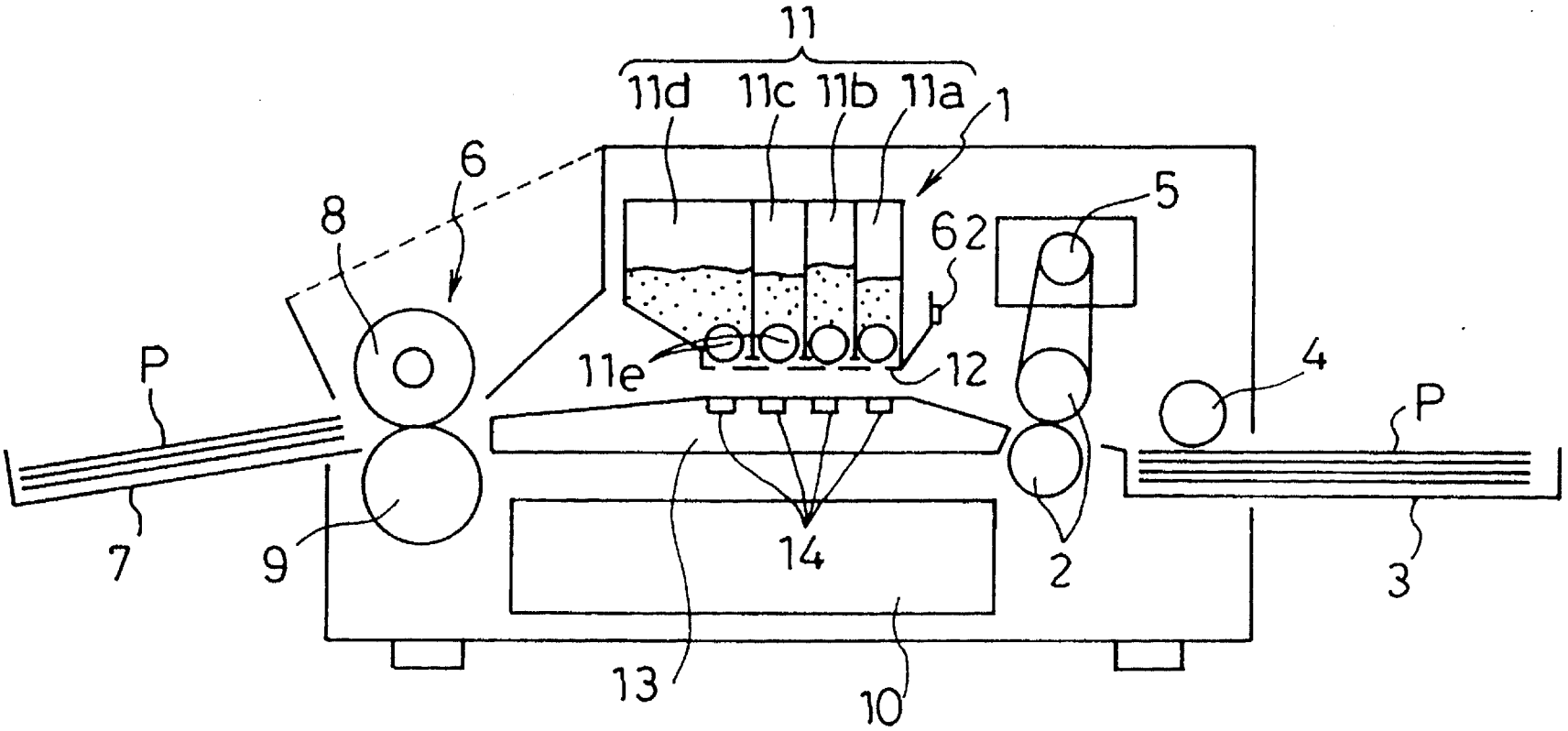
FIG. 2 is a view schematically illustrating the overall structure of the color image forming apparatus including the imaging section shown in FIG. 1.
Figure 6:
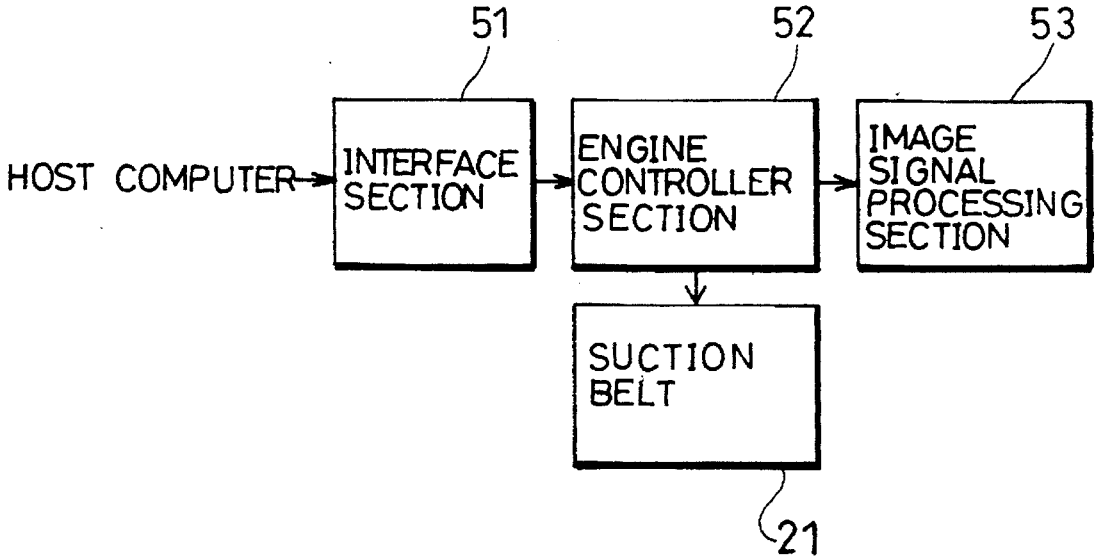
FIG. 6 is a schematic block diagram showing the structure of a control section of the color image forming apparatus.

As illustrated in FIG. 2, a color image forming apparatus of this embodiment includes an imaging section 1 for forming a toner image on recording paper P at a center section thereof. Disposed on the paper input side to the imaging section 1 are a pair of transport rollers 2 for transporting recording paper P to the imaging section, and a paper cassette 3 for storing the recording paper P. The recording paper P in the paper cassette 3 is fed by a feed roller 4, and transported to the imaging section 1 by the transport rollers 2 which are rotated by a motor 5. Disposed on the paper output side from the imaging section 1 are a fuser 6 as fusing means and a paper output tray 7. The fuser 6 includes a heat roller 8 and a pressure roller 9 which is pressed against the heat roller 8. The fuser 6 fixes a toner image on the recording paper P by heating, and outputs the recording paper P on the paper output tray 7. The transport of the recording paper P between the transport rollers 2 and the fuser 6 is carried out, for example, by a suction belt 21 as recording paper transporting means as shown in FIG. 6. The suction belt 21 is a known device which transports the recording paper P by sticking thereto both edges in a cross direction of the recording paper P on a transport guide plate 13. Disposed below the imaging section 1 is a controller 10 which is stored in a box.

Figure 3:
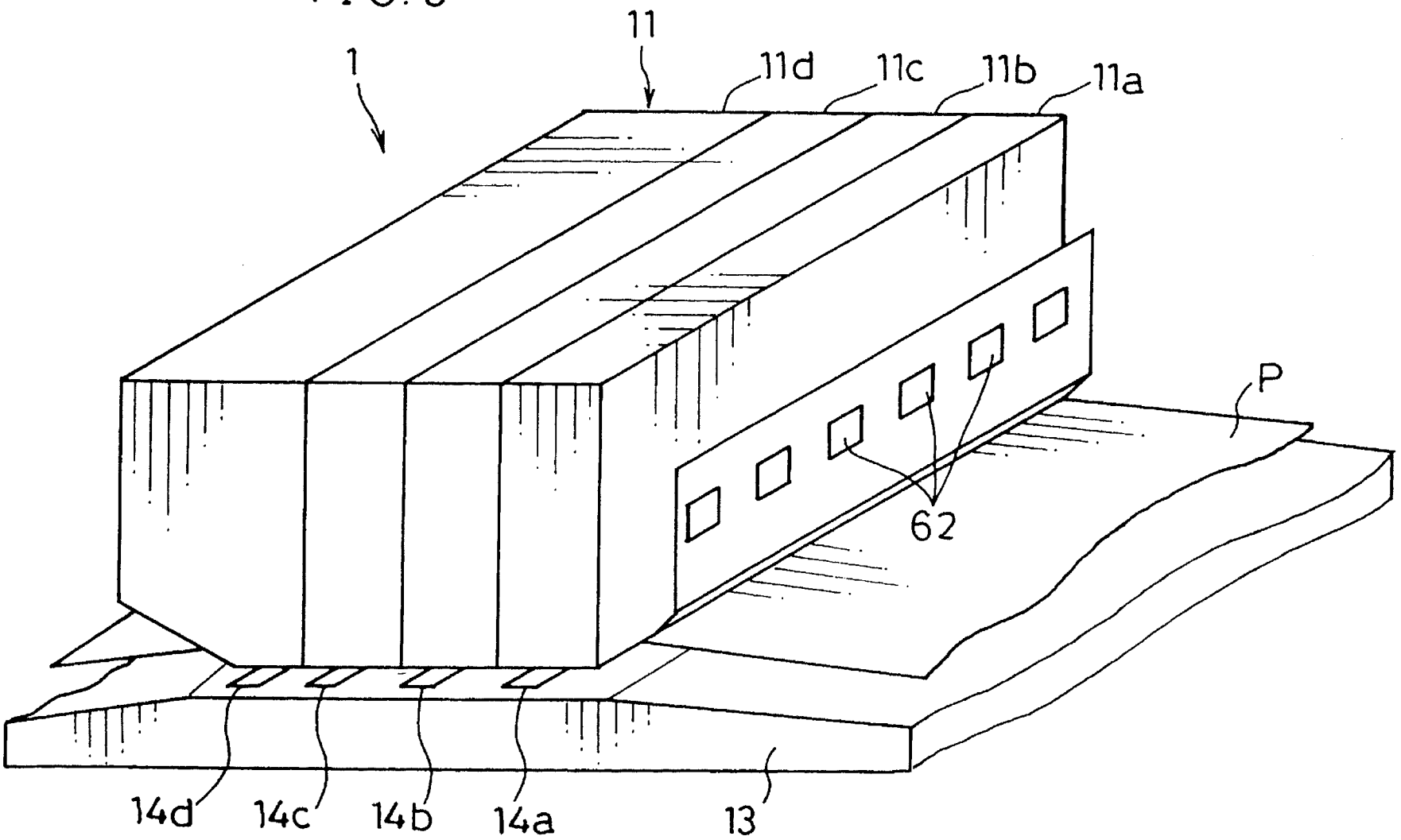
FIG. 3 is a perspective view of the imaging section of the color image forming apparatus shown in FIG. 2.
Figure 4:
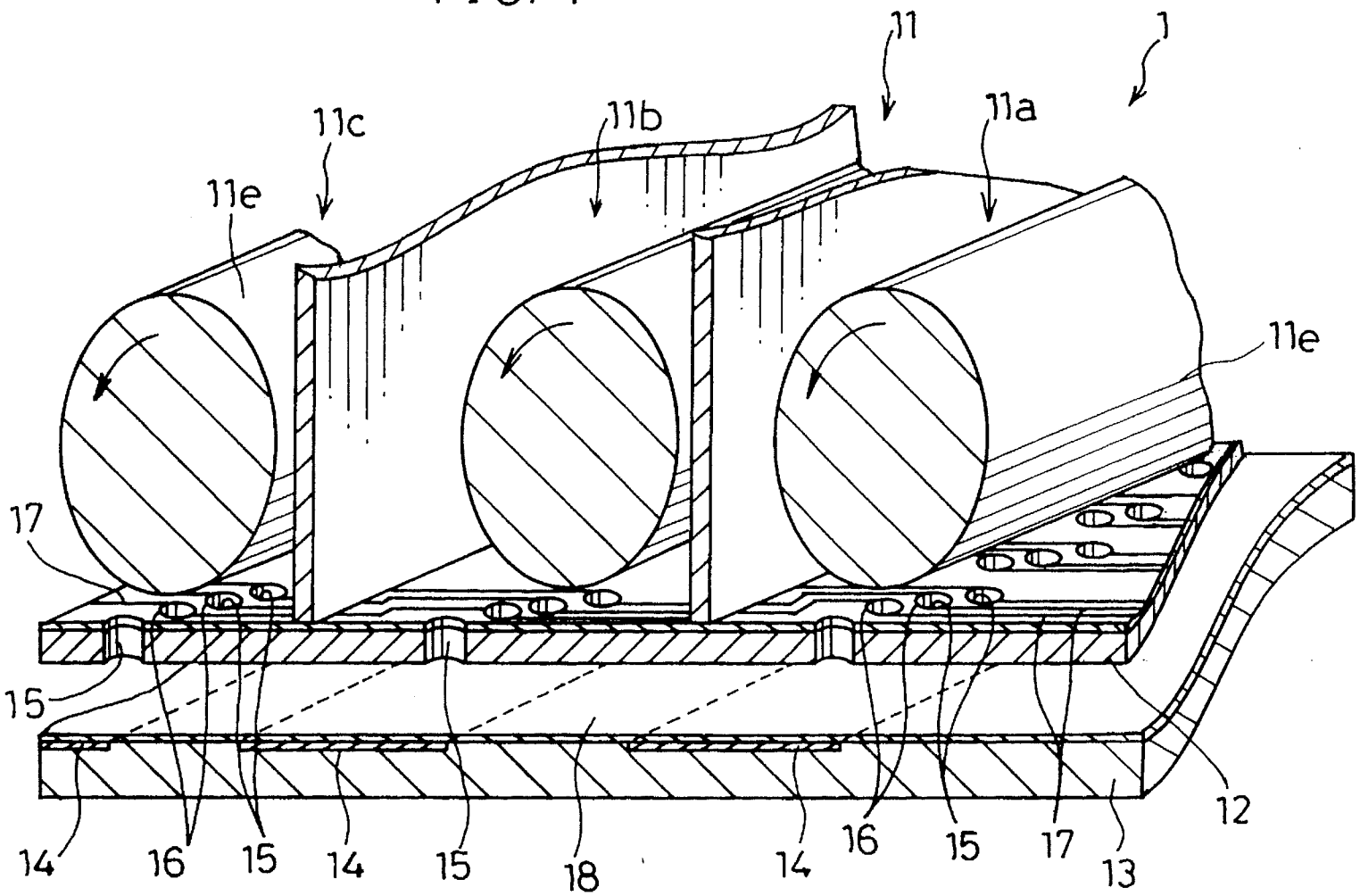
FIG. 4 is a perspective view of a vertical section of essential portions of the imaging section shown in FIG. 3.

The imaging section 1 includes a toner tank unit 11, a driver substrate 12 as an insulating substrate, and the transport guide plate 13. Toner tanks 11*a* to 11*d* for storing yellow, magenta, cyan, and black toners, respectively, are integrated into the toner tank unit 11. As illustrated in FIG. 3, the toner tanks 11*a* to 11*d* are arranged in this order from the upstream side toward a downstream side in a transport direction of the recording paper P. As illustrated in FIG. 4, a development roller 11*e* as a toner carrier having a cylindrical shape is disposed at a lower section of each of the toner tanks 11*a* to 11*d*.

Figure 10:
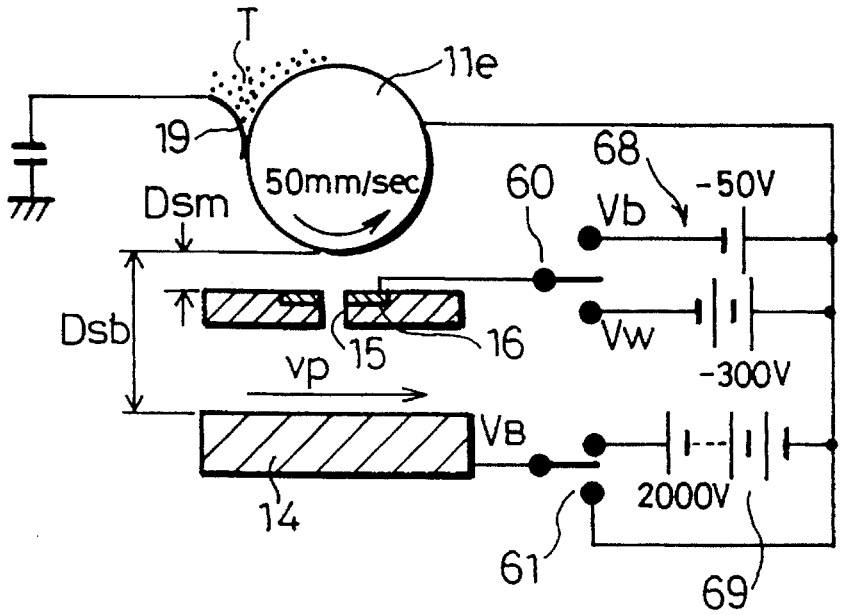
FIG. 10 is a depiction showing the structure of FIG. 1 in a simplified manner to explain a toner antisticking function.

The development roller 11*e* has a conductivity at least on the surface. For example, protrusions and recessions are formed on the surface so that toner is mechanically held thereon. The toner has an insulating property. For example, as shown in FIG. 10, the toner is charged to have a predetermined potential (a negative potential in this embodiment) by friction between the development rollers 11*e* and a sliding blade 19. The toner is chargeable to have a predetermined amount of charge because additives such as silica and alumina are added thereto. Therefore, the toner is electrostatically and mechanically transported by the development rollers 11*e*.

With respect to the structure for transporting toner, it is possible to adopt a structure using semiconducting rollers instead of the development rollers 11*e*, a structure in which toner is electrostatically attracted by magnetic carrier particles and transported together with the carries by a development roller which has magnetism on the surface, and a structure in which magnetic particles are dispersed to the toner so as to give a magnetic property to the toner and the toner is transported by a development roller which has magnetism on the surface as well as the above-mentioned structure.

The driver substrate 12 is disposed below the toner tank unit 11, and has at least a length and width so that it faces all the development rollers 11*e*, i.e., from the development roller 11*e* of the toner tank 11*a* located at one end to the development roller 11*e* of the toner tank 11*d* located at the other end. As illustrated in FIG. 4, a number of toner passing holes 15 are formed on the driver substrate 12 at locations facing the development rollers 11*e*.

Figure 5:
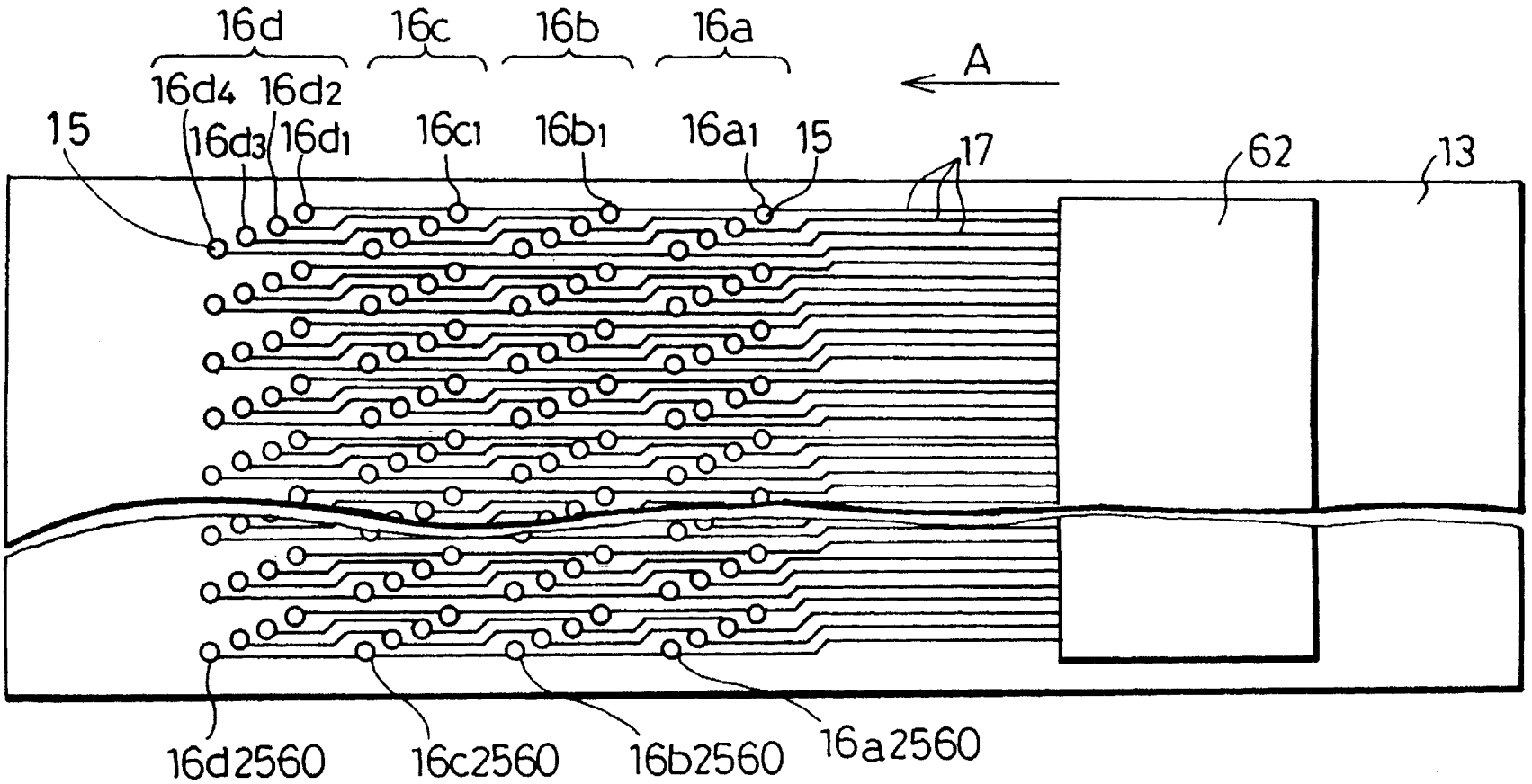
FIG. 5 is an explanatory view showing control electrodes mounted on a driver substrate shown in FIG. 1.

The toner passing holes 15 are arranged into lines following an orthogonal direction with respect to the transport direction of the recording paper P, indicated by arrow A in FIG. 5. For example, as illustrated in FIG. 5, four toner passing holes 15 are arranged in a row, and a number of rows parallel to each other are produced in a cross direction of the driver substrate 12, i.e., the axis direction of each development roller 11*e*. As to the toner passing holes 15 which face and belong to one development roller 11*e*, the toner passing holes 15 which are located in the corresponding position of the respective rows, for example, the first toner passing holes on the respective rows are arranged substantially on the same line along the direction A. The locations of rows of the toner passing holes 15 belonging to the respective development rollers 11*e* are determined so that rows with the same row number counted from one side in the cross direction of the driver substrate 12 are aligned substantially on the same line. Namely, the first row belonging to one development roller 11*e* is substantially aligned with the first rows belonging to other development rollers 11*e*. The same can be said about the second rows, and other rows.

A circular control electrode 16 is formed around each toner passing hole 15 on the surface of the driver substrate 12, which faces the toner tank unit 11. In FIG. 5, the control electrodes 16 belonging to the development rollers 11*e* of the toner tanks 11*a* to 11*d* for storing yellow, magenta, cyan and black toners are represented by numerals 16*a* to 16*d*, respectively. For example, the first control electrode in the first row of the control electrodes 16*a* is denoted by $\mathbf{16}a_1$, and the last control electrode in the last row is denoted by $\mathbf{16}a_{2560}$. In this embodiment, the number of the control electrodes 16, i.e., the number of the toner passing holes 15 belonging to one development roller 11*e* is 2560, and the number of rows thereof is 640.

The control electrodes 16 which belong to different development rollers 11*e* but are located in the rows of the same row number counted from one side in the cross direction of the driver substrate 12 and located on positions of the same number counted from one side of the row, i.e., $\mathbf{16}a_1$, $\mathbf{16}b_1$, $\mathbf{16}c_1$, $\mathbf{16}d_1$, are connected to each other with a connecting wire 17. In short, the control electrodes 16 of respective colors forming one pixel are electrically connected to each other. The connecting wires 17 are connected to driver ICs 62 mounted on the driver substrate 12. For example, the control electrodes 16 and the connecting wires 17 are formed by a printed circuit. As illustrated in FIGS. 2 and 3, a portion of the driver substrate 12 where the driver ICs 62 are mounted is bent upward near the toner tank 11*a*.

The transport guide plate 13 guides the recording paper P passing through the imaging section 1. At least a space larger than the thickness of the recording paper P is formed between the top surface of the transport guide plate 13 and the driver substrate 12 for the transport of the recording paper P. Back electrodes 14 are formed on the top surface of the transport guide plate 13 to face the toner passing holes 15. One back electrode 14 is formed for the toner passing holes 15 belonging to one development roller 11*e*. Considering the transport of the recording paper P on the transport guide plate 13, the back electrodes 14 are buried in the top surface of the transport guide plate 13 so as to form an even top surface. In FIG. 3, the back electrodes 14 belonging to the development rollers 11*e* of the toner tanks 11*a* to 11*d* for storing yellow, magenta, cyan and black toners are represented by numerals 14*a* to 14*d*, respectively.

As illustrated in FIG. 4, a semiconducting coating layer 18 is placed on the back electrodes 14. The coating layer 18 smooths the top surface of the transport guide plate 13 so as to achieve a smooth transport of the recording paper P. Namely, although the back electrodes 14 are buried in the top surface of the transport guide plate 13 so as to form an even top surface, gaps may be produced depending on the state of the back electrodes 14 formed and the transfer paper P may be caught in the gaps during transport. In order to solve such problems, the coating layer 18 is formed in this embodiment. Since the coating layer 18 makes the transport surface of the recording paper P even, every portions of the recording paper P can be placed perpendicularly to the moving direction of the toner, thereby printing substantially circular dots on the recording paper P.

When the coating layer 18 is charged, smooth transport is prevented by static electricity. In order to prevent frictional electrification due to the sliding paper P and a short circuit among the back electrodes 14, the coating layer 18 has a semiconducting property with a resistance between $10^7$ and $10^9$ Ω. Since the surfaces of the back electrodes 14 are coated with the coating layer 18, discharging from the back electrodes 14 to which a high voltage is applied is prevented. In order to obtain the semiconducting property, the coating layer 18 is formed by mixing carbon particles into a principal agent made of a resin material, for example, silicon, nylon, or polytetrafluoroethylene.

The controller 10 is provided for controlling the imaging operation, and includes an interface section 51, an engine controller section 52, and an image signal processing section 53 as shown in FIG. 6. Signals including an imaging start instructing signal output from a host computer, not shown, is input to the engine controller section 52 through the interface section 51. The engine controller section 52 includes a CPU (central processing unit), a RAM (random access memory) as an work area of the CPU, and a ROM (read only memory) storing operational programs of the CPU, not shown. The engine controller section 52 sequentially executes control for imaging according to the programs.

Figure 7:
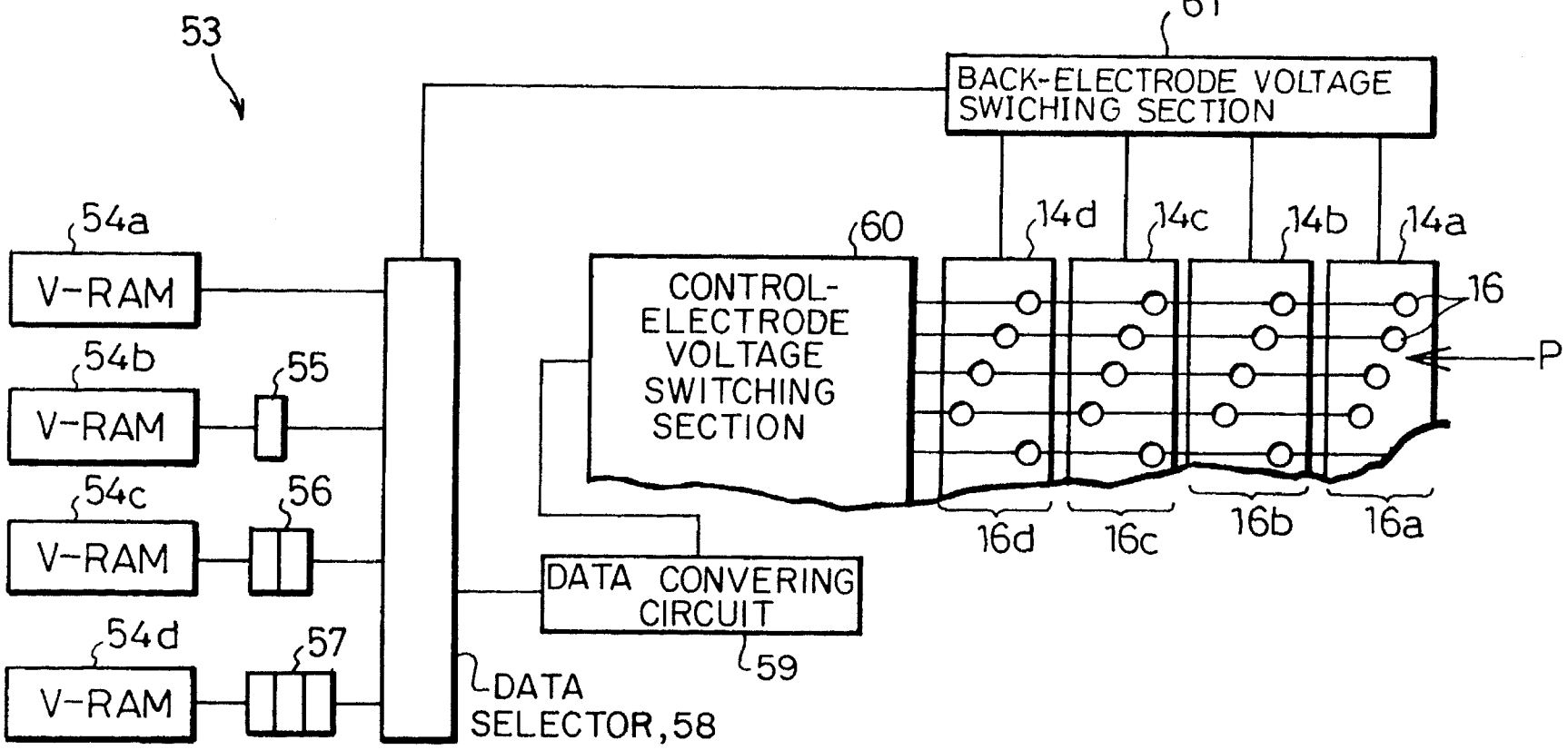
FIG. 7 is a block diagram showing the structure of an image signal processing section shown in FIG. 6.

The image signal processing section 53 applies predetermined signal processing to the image signal input through the engine controller section 52 in a processing section, not shown, for obtaining a quality image. The image signal processing section 53 also performs signal processing by the structure shown in FIG. 7, for driving the control electrodes 16 and the back electrodes 14. As illustrated in FIG. 7, the image signal processing section 53 includes V-RAMs 54*a* to 54*d*, buffers 55 to 57, a data selector 58, a data converting circuit 59, a control-electrode voltage switching section 60, and a back-electrode voltage switching section 61. The control-electrode voltage switching section 60 is signal converting means, and forms control-electrode voltage applying means together with a control-electrode power source 68 (see FIG. 9) as described later. The back-electrode voltage switching section 61 forms back-electrode voltage applying means together with a back-electrode power source 69 (see FIG. 9) as described later.

The V-RAMs 54*a* to 54*d* separately store image signals corresponding to yellow, magenta, cyan and black colors, input to the image signal processing sections 53. The image signals corresponding to the above-mentioned colors are obtained by the host computer, or converting means, not shown. The buffers 55 to 57 temporarily hold the image signals read from the V-RAMs 54*b* to 54*d*. Namely, after a predetermined area of the recording paper P has passed through the section between the control electrode 16*a* and the back electrode 14*a*, the buffer 55 holds the image signal for a time necessary for the predetermined surface to reach the section between the control electrode 16*b* and the back electrode 14*b*. After the predetermined area of the recording paper P has passed through the section between the control electrode 16*a* and the back electrode 14*a*, the buffer 56 holds the image signal for a time necessary for the predetermined surface to reach the section between the control electrode 16*c* and the back electrode 14*c*. After the predetermined surface of the recording paper P has passed through the section between the control electrode 16*a* and the back electrode 14*a*, the buffer 57 holds the image signal for a time necessary for the predetermined surface to reach the section between the control electrode 16*d* and the back electrode 14*d*. The data selector 58 successively selects one of the V-RAMs 54*a* to 54*d*, switches the image signals read from the V-RAMs 54*a* to 54*d*, and sends the image signals to the data converting circuit 59.

The data converting circuit 59 converts the input image signals corresponding to each color into a pattern corresponding to an arrangement of the control electrodes 16 and the toner passing holes 15 which form a print head, and supplies the pattern to the control-electrode voltage switching section 60.

Figure 9:
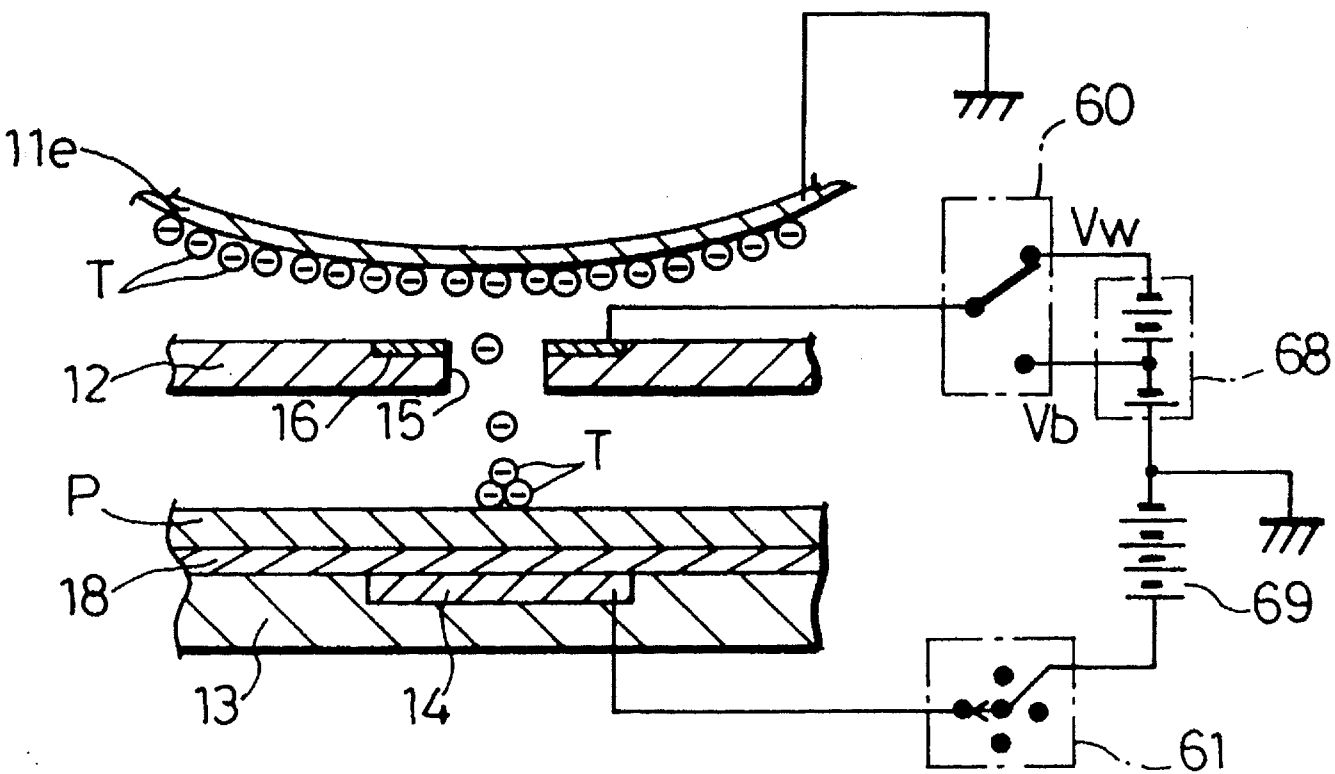
FIG. 9 is a depiction illustrating essential portions of the imaging section having the structure shown in FIG. 7.

The back-electrode voltage switching section 61 successively selects one back electrode to which the voltage is to be applied from the back electrodes 14*a* to 14*d* in this order based on the switching signal of the data selector 58, and applies the voltage of the back-electrode power source 69 shown in FIG. 9 to the selected back electrodes 14*a* to 14*d* in this order. The polarity of the back-electrode power source 69 is opposite to that of the toner. In this embodiment, the back-electrode power source 69 has a positive polarity. With this control, it is possible to timely apply the voltage to the back electrodes 14*a* to 14*d* by the switching signals and the read signals for giving an instruction to read image information from the V-RAMs 54*a* to 54*d*.

Figure 8:
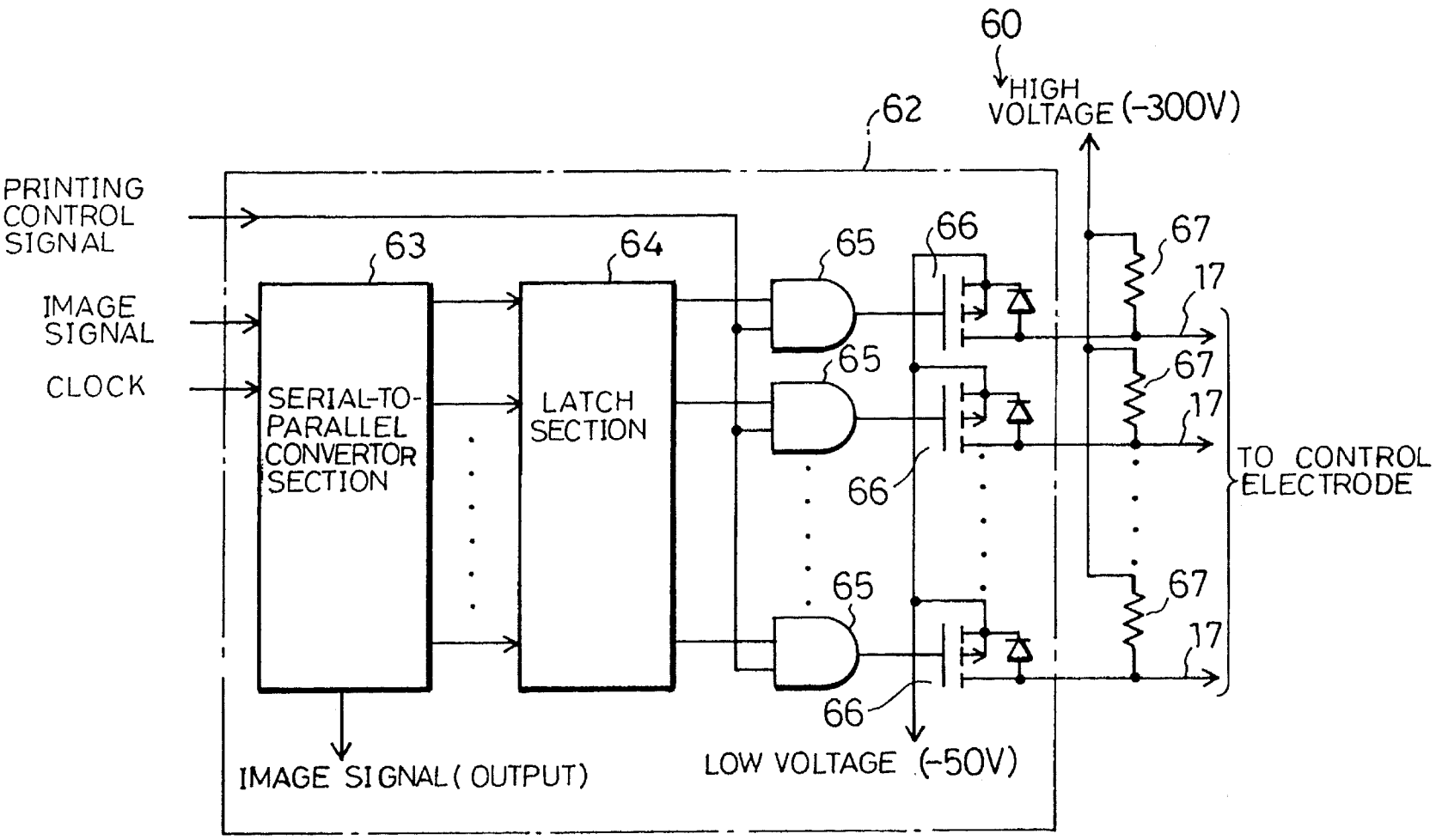
FIG. 8 is a circuit diagram showing the structure of a control-electrode voltage switching section shown in FIG. 7.

The control-electrode voltage switching section 60 has the structure shown in FIG. 8, and includes the driver IC 62. The driver IC 62 includes a serial-to-parallel converting section 63, a latch section 64, AND circuits 65, switching elements 66 formed by FETs. The serial-to-parallel converting section 63 converts serial image signals input from the data converting circuit 59 into parallel image signals, and forms control signal generating means together with the data converting circuit 59. In the serial-to-parallel converting section 63, the serial image signals are converted into the number of parallel signals corresponding to the number of control electrodes 16 belonging to one development roller 11*e*. In this embodiment, the number is 2560. Therefore, 2560 AND circuits 65, switching elements 66 and resistors 67 shown in FIG. 8 are respectively arranged in parallel. Each of the switching elements 66 is connected to the control electrodes 16 with the connecting wires 17.

Each connecting wire 17 is connected to the control-electrode power source 68 shown in FIG. 9 through the resistor 67. The polarity of the control-electrode power source 68 is the same as that of the toner. In this embodiment, the polarity of the control electrode power source 68 is negative.

The image signals output from the serial-to-parallel converting section 63 are supplied to the AND circuits 65, respectively, through the latch sections 64. When an image signal is high and when, for example, a printing control signal supplied by the engine controller section 52 is high, the output of the AND circuit 65 becomes high. On the other hand, when one of these signals is low, the output of the AND circuit 65 becomes low. The output of the AND circuit 65 is input to the gate of the switching element 66. When the output of the AND circuit 65 is high, the switching element 66 is turned on, and the connecting wire 17, i.e., the control electrode 16 connected to the connecting wire 17 has a low electric potential because of a low voltage supplied by the control-electrode power source 68. On the other hand, when the output of the AND circuit 65 is low, the switching element 66 is turned off and the above-mentioned control electrode 16 has a high electric potential because of a relatively high voltage supplied by the control-electrode power source 68. Therefore, the voltages of the control electrodes 16 are modulated according to the control signals generated based on the image signals. The driver IC 62 and a circuit for supplying a control voltage are connected to each other on the driver substrate 12.

Figure 1:
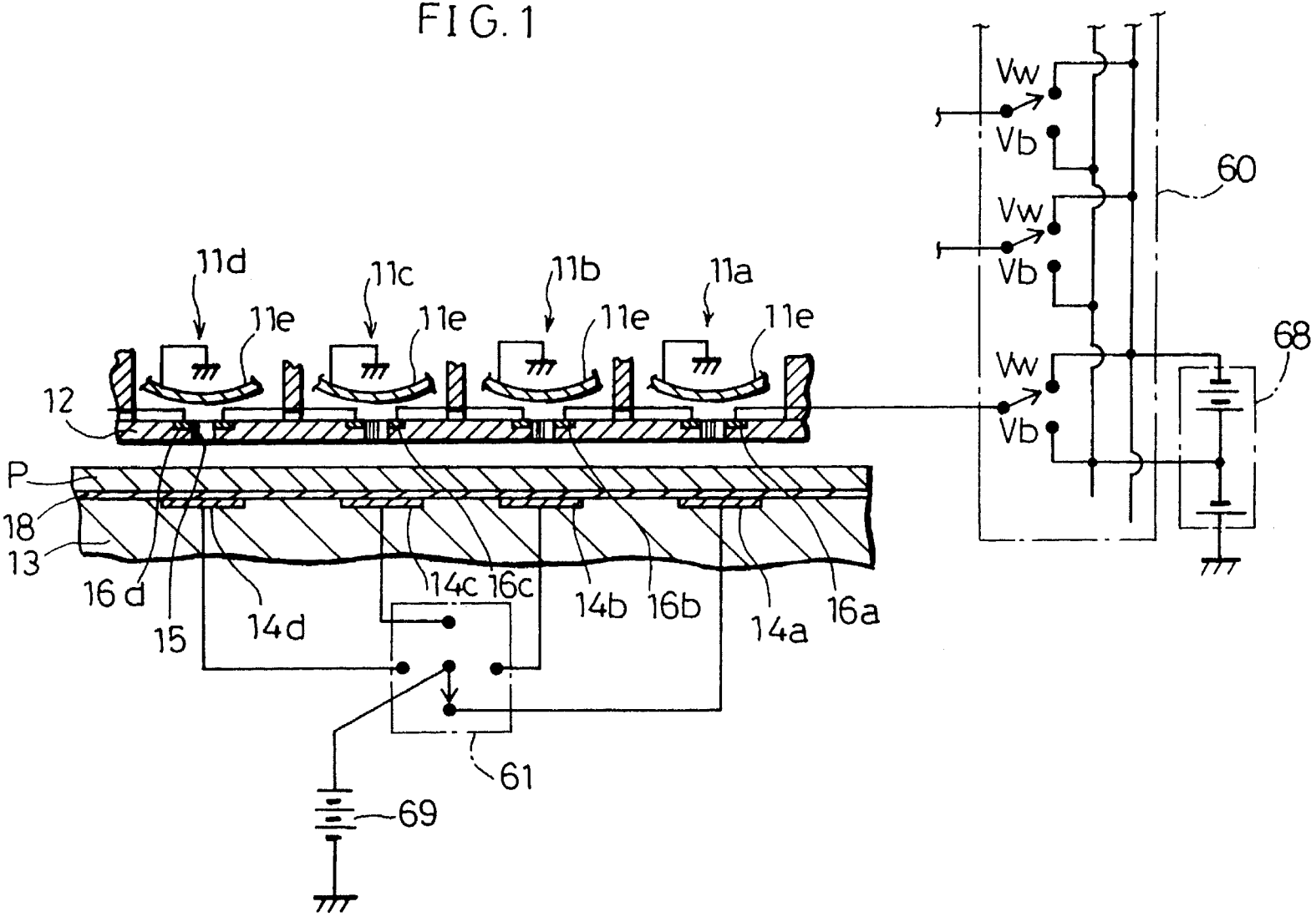
FIG. 1 is a depiction illustrating the structure of an imaging section of a color image forming apparatus according to one embodiment of the present invention.

FIG. 9 is a view schematically showing one of the toner tanks 11*a* to 11*d* and an essential structure of the imaging section 1 including the structure shown in FIG. 7. FIG. 1 shows the structure as a structure corresponding to the toner tanks 11*a* to 11*d*. In FIGS. 1 and 7, a voltage Vb shown at the control-electrode voltage switching section 60 corresponds to the low voltage shown in FIG. 8, and is a voltage for causing toner to fly from the development rollers 11*e* through the toner passing holes 15 toward the back electrodes 14, i.e., a print voltage for printing an image on the recording paper P between the control electrodes 16 and the back electrodes 14 using the toner. A voltage Vw corresponds to the high voltage shown in FIG. 8, and is a voltage for preventing the toner from flying from the development rollers 11*e* through the toner passing holes 15 toward the back electrodes 14, i.e., a print stop voltage for preventing printing an image on the recording paper P with the toner. The print voltage Vb and the print stop voltage Vw have the same polarity as that of the toner.

In this structure, when an instruction signal to start imaging is input to the engine controller section 52 from the host computer, a motor shown in FIG. 5 is rotated under the control by the controller section 52. As a result, the feed roller 4, the transport rollers 2, the suction belt 21 and the development rollers 11*e* in the toner tanks 11*a* to 11*d* are rotated. With the rotation of the development rollers 11*e*, the toners in the toner tanks 11*a* to 11*e* are agitated. At this time, the toners are pushed against the development rollers 11*e* by the blade (see FIG. 10), and charged in a negative polarity by friction. The development rollers 11*e* have the same electric potential as the toners or are grounded.

When the topmost recording paper P in the paper cassette 3 is fed by the feed roller 4 and nipped between the transport rollers 2, the feed roller 4 is driven with the movement of the recording paper P. The recording paper P nipped between the transport rollers 2 is transported through the section between the driver substrate 12 and the back electrodes 14 in the imaging section 1 by the suction belt 21.

On the other hand, the image signals of the respective colors from the host computer or the converting means are temporarily stored in the V-RAMs 54*a* to 54*d* of the image signal processing section 53 shown in FIG. 7, and then transferred directly or through the buffers 55 to 57 to the data selector 58. More specifically, the image signals stored in the V-RAMS 54*a* to 54*d* are sequentially read out from an address of the smallest number based on a clock, not shown. The yellow image signal read from the V-RAM 54*a* is directly input to the data selector 58. The magenta, cyan and black image signals read from the V-RAM 54*b* to 54*d* are input to the data selector 58 through the buffers 55 to 57, respectively. Consequently, the magenta, cyan and black image signals are successively input to the data selector 58 with delay with respect to the input of the yellow image signal. The data selector 58 successively switches the image signals based on a switching signal supplied from, for example, the engine controller section 52 and transfers the image signals to the data converting circuit 59. In this case, the yellow image signal is first selected, and transferred to the data converting circuit 59.

The image signal input to the data converting circuit 59 is converted into an electrode pattern of the control electrodes 16, i.e., a pattern corresponding to the alignment of the toner passing holes 15, and then supplied to the control-electrode voltage switching section 60. In the control-electrode voltage switching section 60, as illustrated in FIG. 8, the serial image signals input to the serial-to-parallel converting section 63 are converted into parallel image signals. The voltage to be applied to the control electrodes 16 are modulated based on the converted image signals. More specifically, when the image signals are in a print level which is higher than a predetermined reference level, the print voltage Vb that is a relatively low voltage is supplied to the control electrodes 16 from the control-electrode power source 68 by the switching operation of the control-electrode voltage switching section 60 in FIG. 1. When the image signal is in a non-print level which is lower than the predetermined reference level, the print stop voltage Vw which is a relatively high voltage is supplied to the control electrodes 16 from the control-electrode power source 68.

Meanwhile, the back-electrode voltage switching section 61 first selects the back electrode 14*a* corresponding to yellow based on the switching signal in the data selector 58, and applies the voltage from the back-electrode power source 69 to the back electrode 14*a*.

In FIG. 9, when the voltage is applied to the back electrode 14*a* from the back-electrode power source 69, an electric field with a strength in a direction, which is capable of causing the toner held on the development roller 11*e* to fly toward the back electrode 14*a*, is generated between the development roller 11*e* and the back electrode 14*a*. At this time, if the print voltage Vb is supplied to the control electrode 16*a*, the toner can pass thorough the toner passing holes 15 and reach the recording paper P without being prevented from flying. Therefore, the print voltage Vb is lower than an electric potential that is generated at the position of the control electrode 16*a* by the electric field between the development roller 11*e* and the back electrode 14*a*. On the other hand, when the print stop voltage Vw is applied to the control electrode 16*a*, the toner is prevented from flying from the development roller 11*e* through the toner passing holes 15 to the back electrode 14*a*. Therefore, the print stop voltage Vw is higher than the electric potential produced at the position of the control electrode 16*a* by the electric field between the development roller 11*e* and the back electrode 14*a*.

With the above-mentioned operation, a yellow image is formed on the recording paper P. The control of the application of the voltage to the control electrode 16*a* and the back electrode 14*a* is started when the printable start section of the recording paper P reaches a predetermined position between the control electrode 16*a* and the back electrode 14*a* corresponding to the yellow toner tank 11*a*.

The recording paper P is continuously moved from the paper input side with respect to the image section 1 toward the paper output side. When the yellow image thus formed reaches the section between the control electrode 16*b* and the back electrode 14*b* corresponding to the magenta toner tank 11*b*, the control electrode 16*b* is controlled based on the magenta image data read from the V-RAM 54*b*. A magenta toner image is formed over the yellow toner image in a manner similar to the above. In this case, in a period in which the yellow toner image is moved to the section between the control electrode 16*b* and the back electrode 14*b*, blank data stored in the buffer 55 is input to the control-electrode voltage switching section 60, and the magenta image signal which has passed through the buffer 55 is input to the control-electrode voltage switching section 60 in synchronous with the arrival of the yellow toner image at the section between the control electrode 16*b* and the back electrode 14*b*.

Imaging is performed in the same manner based on the cyan image signal which has passed through the buffer 56 and the black image signal which has passed through the buffer 57. As a result, the yellow toner image, magenta toner image, cyan toner image and black toner image are superimposed on the recording paper P. Thereafter, the toner images are heated and fused onto the recording paper P by the fuser 6. The recording paper P is then discharged onto the paper output tray 7. In this operation, the speed of switching the voltages of the control electrodes 16 and the back electrodes 14 is so fast, and there is no comparison between the transport speed of the recording paper P and the switching speed.

As described above, in this color image forming device, a voltage whose polarity is the same as that of toner is applied to the control electrodes 16 when performing printing on the recording paper P based on image signals and when performing no printing. It is therefore possible to always prevent the adhesion of toner to the control electrodes 16 and the connecting wires 17 which supply a voltage to the control electrodes 16. The reasons for this are described below.

Here, as illustrated in FIG. 10, the print voltage Vb to be applied to the control electrodes 16, the print stop voltage Vw, the back-electrode voltage $V_B$ to be applied to the back electrodes 14, the distance Dsm between the development rollers 11*e* and the control electrodes 16, and the distance Dsb between the development rollers 11*e* and the back electrodes 14 are set such that Vb=−50 V, Vw=−300 V, $V_B$=2000 V, Dsm=100 μm, Dsb=1 mm.

In FIG. 10, the development rollers 11*e* are rotated at 50 mm/sec, and vp represents a transport speed of the recording paper P.

Figure 11:
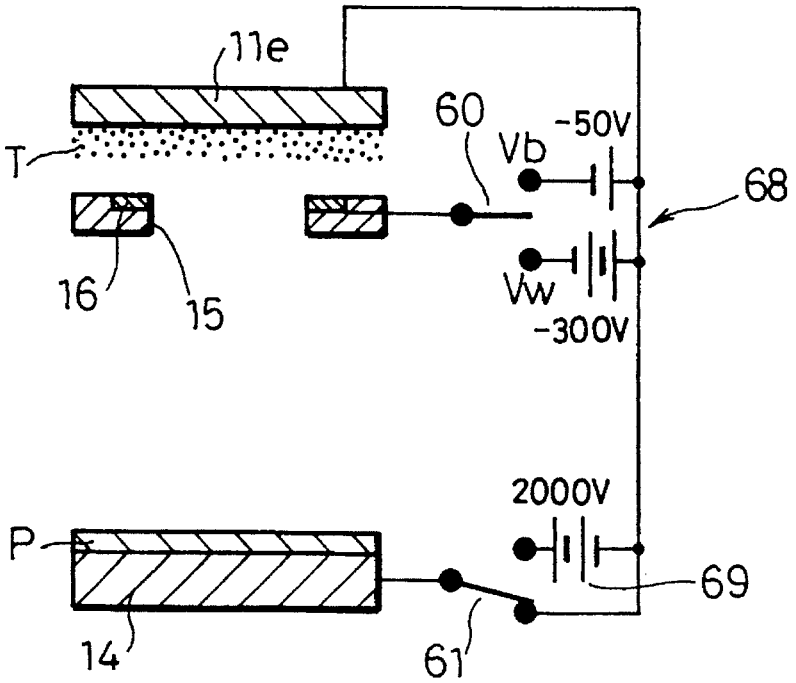
FIG. 11 is a depiction showing the structure of FIG. 10 in a further simplified manner where a back electrode has the same electric potential as development rollers and a control electrode is not connected to any power sources.

FIG. 11 shows a state in which the control electrode 16 is electrically floating, the development roller 11*e* and the back electrode 14 have the same electric potential, and no electric field is present between the development roller 11*e* and the back electrode 14. In this state, toner T charged in a negative polarity adheres to the development roller 11*e*, and is transported in this state.

Figure 12:
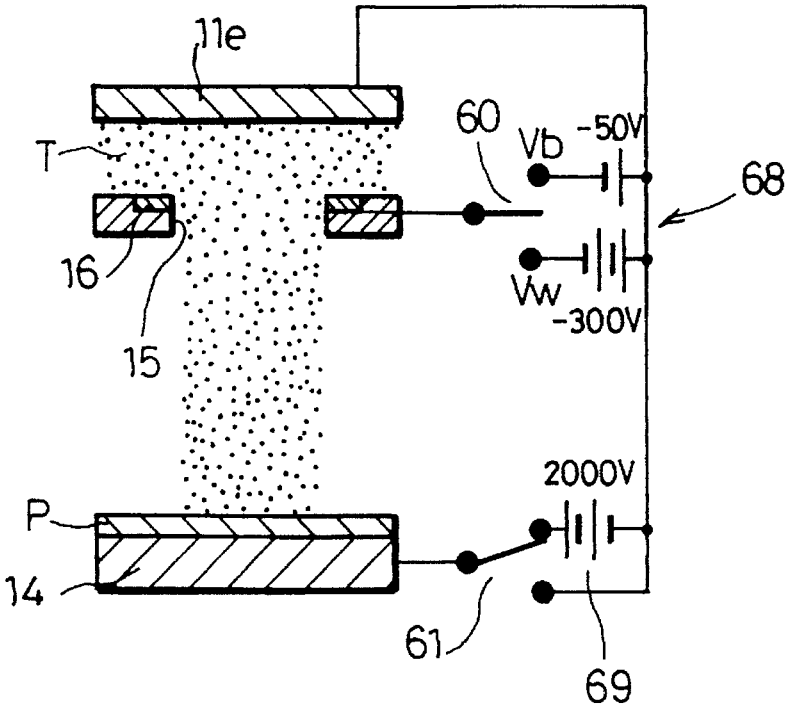
FIG. 12 is a depiction showing a state in which the back electrode is connected to a back electrode power source after the state of FIG. 11.

In the state shown in FIG. 12 where the control electrode 16 is electrically floating and a voltage whose polarity is opposite to that of the toner T is applied to the back electrode 14, the toner T on the development roller 11*e* flows toward the back electrode 14 because of an electric field produced between the back electrode 14 and the development roller 11*e*. In this case, since the control electrode 16 does not affect the electric field, the toner T flies toward the entire surface of the substrate on which the control electrode 16 is mounted. Only the toner T flying toward the toner passing holes 15 reaches the back electrode 14, i.e., the recording paper P. This state is not preferable because the toner T is accumulated on the control electrode 16.

Figure 13:
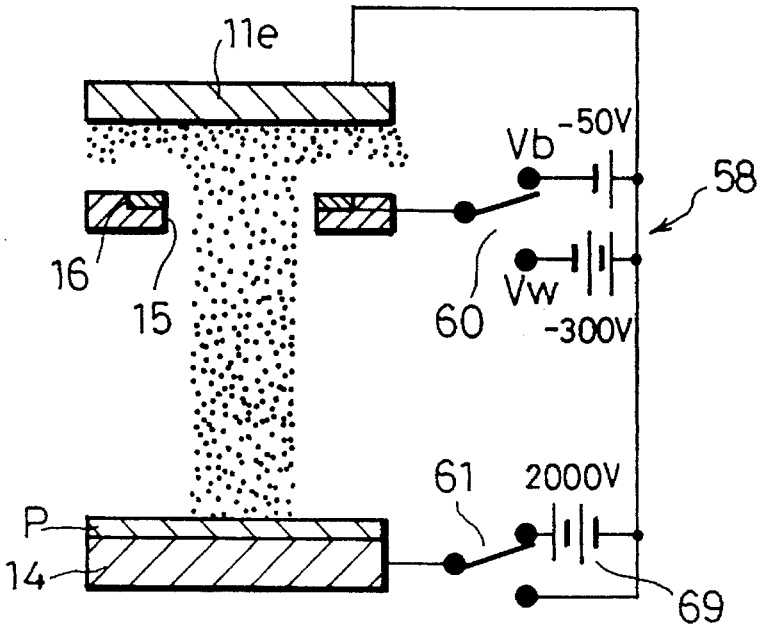
FIG. 13 is a depiction showing a state in which the back electrode is connected to the back electrode power source and a print voltage Vb is applied to the control electrode after the state of FIG. 11.
Figure 14:
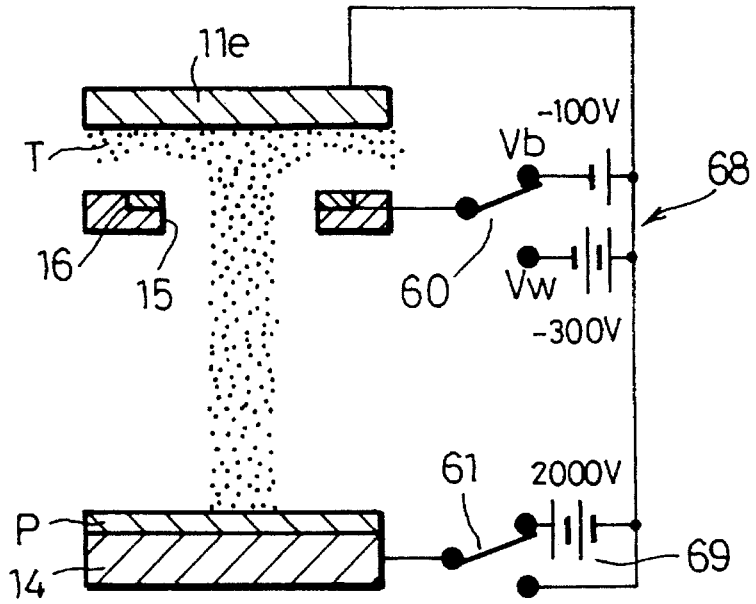
FIG. 14 is a depiction illustrating another example of the state shown in FIG. 13.

When the voltage of the opposite polarity to the toner T is applied to the back electrode 14, the toner T held on the development roller 11*e* flies towards the back electrode 14. At this time, as illustrated in FIGS. 13 and 14, if a voltage of the same polarity as the toner T is applied to the control electrode 16, an electric field between the development roller 11*e* and the back electrode 14, is narrowed down in the toner passing hole 15 according to the voltage value. As a result, a beam of toner T with a diameter smaller than that of the control electrode 16, i.e., the diameter of the toner passing hole 15, is produced, and a repulsive force is exerted from the control electrode 16 to the toner T.

Figure 15:
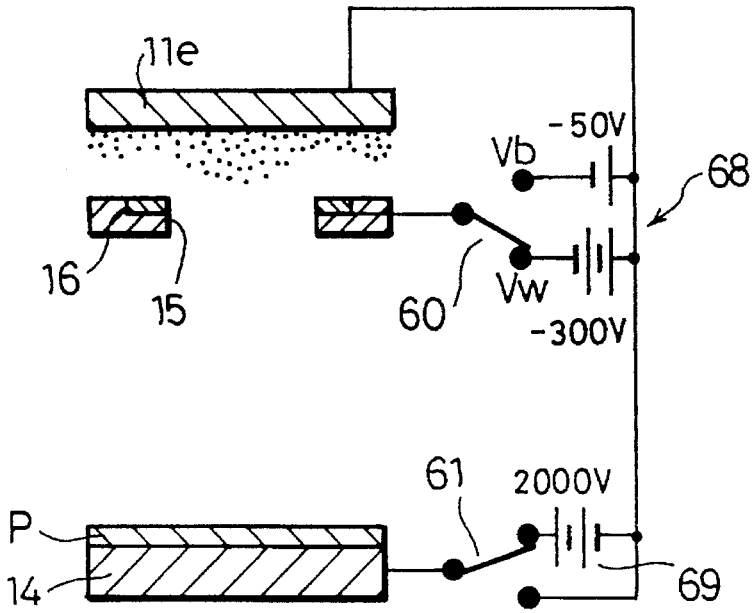
FIG. 15 is a depiction showing a state in which an applied voltage to the control electrode is switched to a print stop voltage Vw after the state of FIG. 14.

As illustrated in FIG. 15, when a higher voltage of the same polarity as the toner T is applied to the control electrode 16, an electric field between the development roller 11*e* and the back electrode 14 is completely blocked by an electric field generated by the voltage applied to the control electrode 16, thereby preventing the toner T from flying through the toner passing holes 15.

Figure 16:
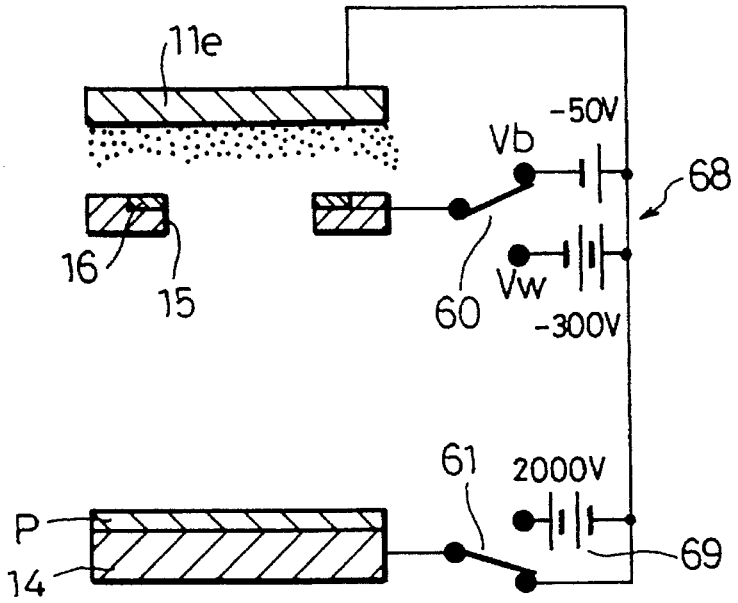
FIG. 16 is a depiction showing a state in which the print voltage Vb is applied to the control electrode after the state of FIG. 11.
Figure 17:
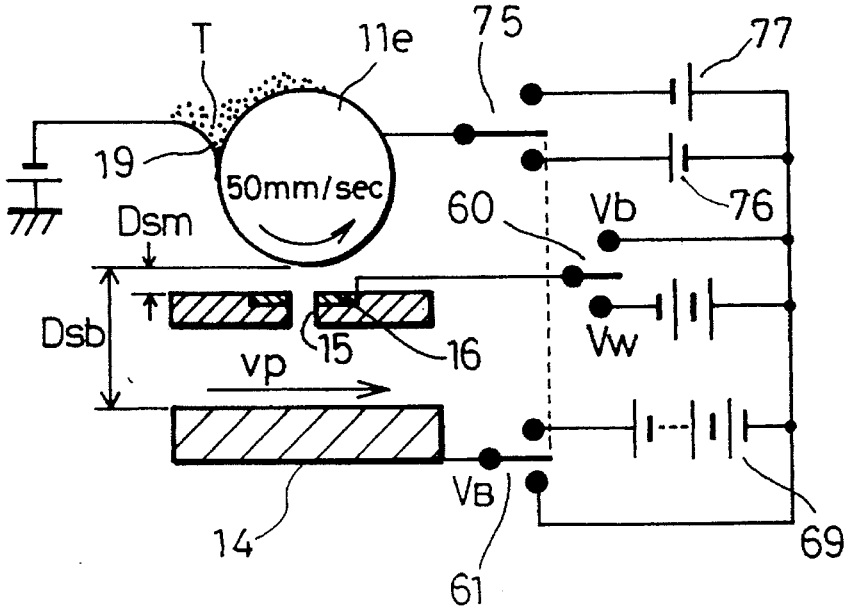
FIG. 17 is a depiction illustrating the structure in which the toner antisticking function with respect to the control electrode is further improved compared to the structure of FIG. 10.

On the other hand, as shown in FIG. 16, when the back electrode 14 and the development roller 11*e* have the same electric potential, for example, if printing with toner T of a predetermined color is not selected and if the print voltage Vb is applied to the control electrode 16, an electric field whose direction is opposite to that in printing is produced in the toner passing hole 15. Thus, the toner T does not fly from the development roller 11*e* toward the back electrode 14.

As described above, in the color image forming apparatus of this embodiment, by applying a voltage exhibiting the same polarity as the toner to the control electrode 16 during printing using the toner which has passed through the toner passing holes 15 and during non-printing for preventing the printing operation, an electric field for producing repulsion against the toner is produced at least around the control electrode 16 and the connecting wire 17 which supplies power to the control electrode 16.

Therefore, the adhesion of toner to the control electrode 16 and the connecting wire 17 is prevented during printing and non-printing. It is thus possible to prevent the recording paper P from being made dirty by dropping of toner accumulated on the control electrode 16 and the connecting wire 17, the toner passing holes 15 from being clogged with toner, and a lowering of the printing quality due to instability of the electric field around the control electrode 16 caused by the accumulated toner.

As illustrated in FIG. 5, since the control electrodes 16 of the respective colors are electrically connected to each other with the connecting wires 17, the above voltage exhibiting the same polarity as toner is applied not only to the control electrode 16 of the toner passing holes 15 which are not used for printing among a number of control electrodes 16 corresponding to a color selected for forming an image, but also to the control electrodes 16 corresponding to colors which are not selected for forming the image during non-printing.

In this color image forming apparatus, the direction of an electric field produced in the toner passing holes 15 by the application of the voltage to the control electrodes 16 is made opposite to each other during printing and non-printing so as to prevent the toner from adhering to the control electrodes 16. In order to improve this function, for example, the structure shown in FIG. 17 may be adopted.

In this structure, for example, the toner T charged in a negative polarity is used, a switching section 75 which is driven together with the back-electrode voltage switching section 61 is connected to the development roller 11*e*. The switching section 75 can select a positive power source 76 or a negative power source 77. The control-electrode voltage switching section 60 selects the print stop voltage Vw from the negative power source 77 and the print voltage Vb set at 0 V. In this structure, a positive back-electrode power source 69 is connected to the back electrode 14, the negative power source 77 is connected to the development roller 11*e*, and the control electrode 16 becomes 0 V during printing. Therefore, the toner T produces a repulsive force against the development roller 11*e*, and flies toward the back electrode 14 without being stopped by the electric field of the control electrode 16. On the other hand, during non-printing, the back electrode 14 becomes 0 V, the positive power source 76 is connected to the development roller 11*e*, and the print stop voltage Vw is supplied to the control electrode 16. Therefore, the toner T adheres to the development roller 11*e*, and the direction of the electric field between the toner passing hole 15 and the development roller 11*e* becomes opposite to the direction in printing, stopping the toner T from flying to the control electrode 16. Consequently, the adhesion of the toner T to the control electrode 16 is surely prevented.

Alternatively the following structures may be used for preventing the adhesion of toner to the control electrodes 16 during non-printing by reversing the direction of the electric field between the development rollers 11*e* and the toner passing holes 15 in printing and non-printing.

Figure 18:
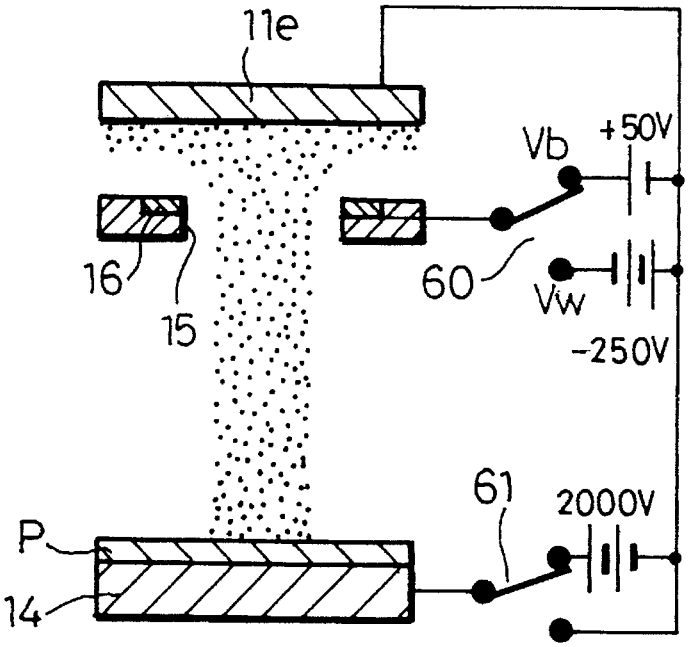
FIG. 18 is a depiction illustrating another example of the structure having the toner antisticking function with respect to the control electrode shown in FIG. 10 and a printing state in this structure.

In FIG. 18, for example, when a voltage of 2000 V is applied to the back electrode 14 disposed in a position 1 mm distant from the development roller 11*e*, if the control electrode 16 is separated from the development roller 11*e* by 0.2 mm and is not connected to a power source, the electric potential at the position of the control electrode 16 becomes 400 V. Therefore, when a positive print voltage Vb (+50 V) lower than 400 V is applied to the control electrode 16, even the toner T of the negative polarity produces a toner beam with a diameter smaller than the diameter of the control electrode 16, i.e., the diameter of the toner passing hole 15, by the repulsive force from the control electrode 16. It is thus possible to perform desired printing according to the voltage of a polarity opposite to the toner T, applied to the control electrode 16.

Figure 19:
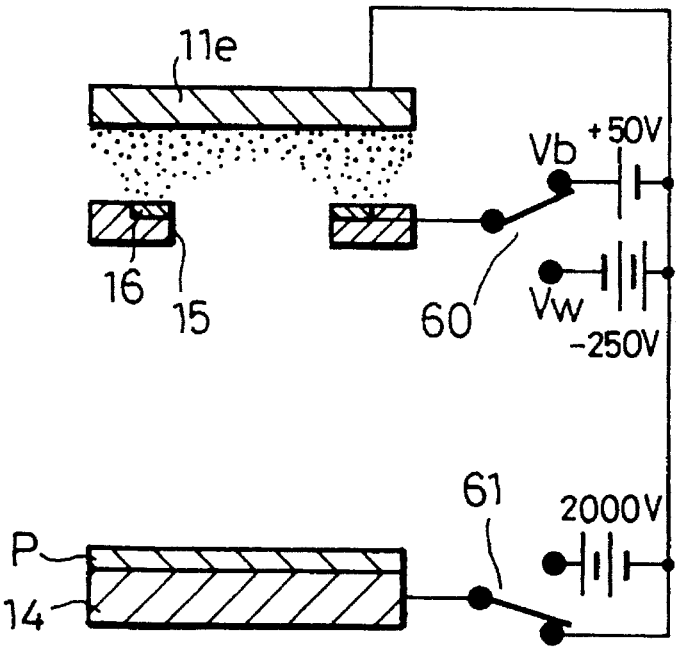
FIG. 19 is a depiction showing a state in which the back electrode is switched to 0 V which is the same as the development roller after the state of FIG. 18.

In this structure, however, when the application of the voltage to a section between the development roller 11*e* and a predetermined back electrode 14 is made impossible by switching the predetermined back electrode 14 to the other, if a positive print voltage Vb is applied, a part of toner T near the development roller 11*e* flies toward and is accumulated on the control electrode 16 as shown in FIG. 19.

Figure 20:
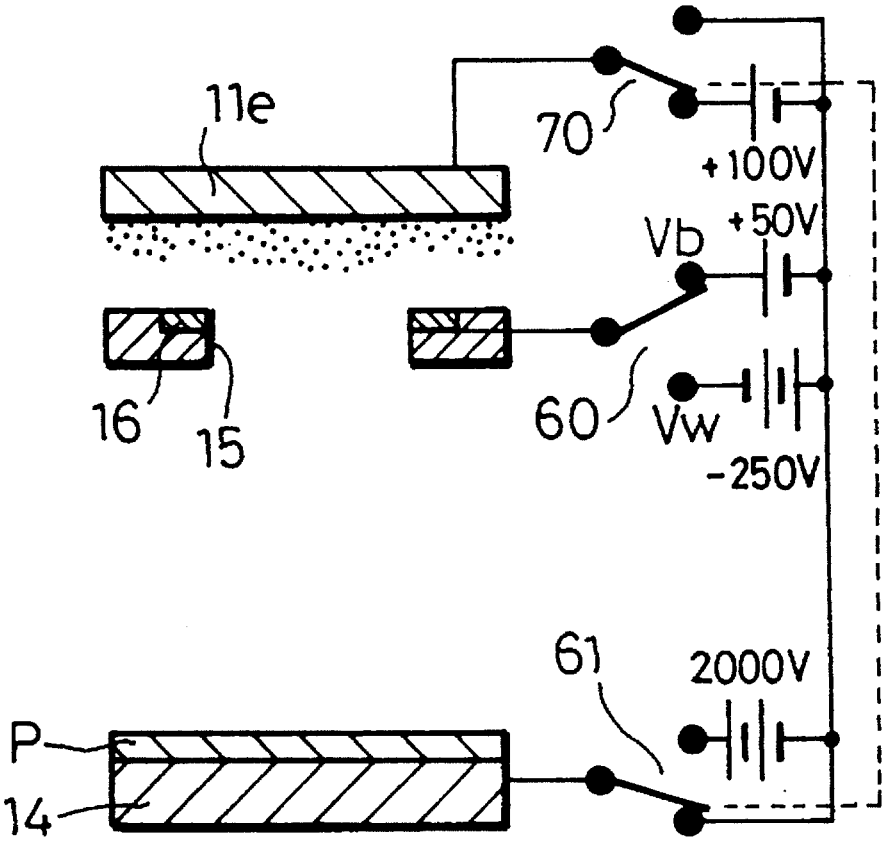
FIG. 20 is a depiction illustrating the structure having the toner antisticking function with respect to the control electrode in addition to the structure of FIG. 18.

In order to solve such a problem, a switching section 70 which moves together with the back-electrode voltage switching section 61 is provided to perform non-printing as shown in FIG. 20. A positive voltage greater than the print voltage Vb (+50 V) is applied to the development roller 11*e* by the switching operation of the switching section 70 during non-printing. As a result, an electric field whose direction is opposite to that of the electric field used in printing, is generated in the section between the development roller 11*e* and the toner passing holes 15, thereby solving the above problems.

This color image forming apparatus for forming a color image on the recording paper P using color toners may employ a subtractive color mixture method of mixing four colors, i.e., yellow, magenta, cyan and black. This method can produce any color by varying the density of each color and combining the respective colors. With respect to a method for exhibiting densities, a method (density gradation) changes the amount of adhering toner, and a method (area gradation) visually changes the density by varying the area. The color image forming apparatus of this embodiment can very precisely determine the positions of pixels, and the pixel diameter of each color. It is thus possible to form one pixel by superimposing dots of the respective colors, and exhibit the color of one pixel by positioning the dots of the respective colors in different locations according to the area ratio of the respective colors. The following description will explain adoption of these two methods in the color image forming apparatus of this embodiment.

Figure 21:
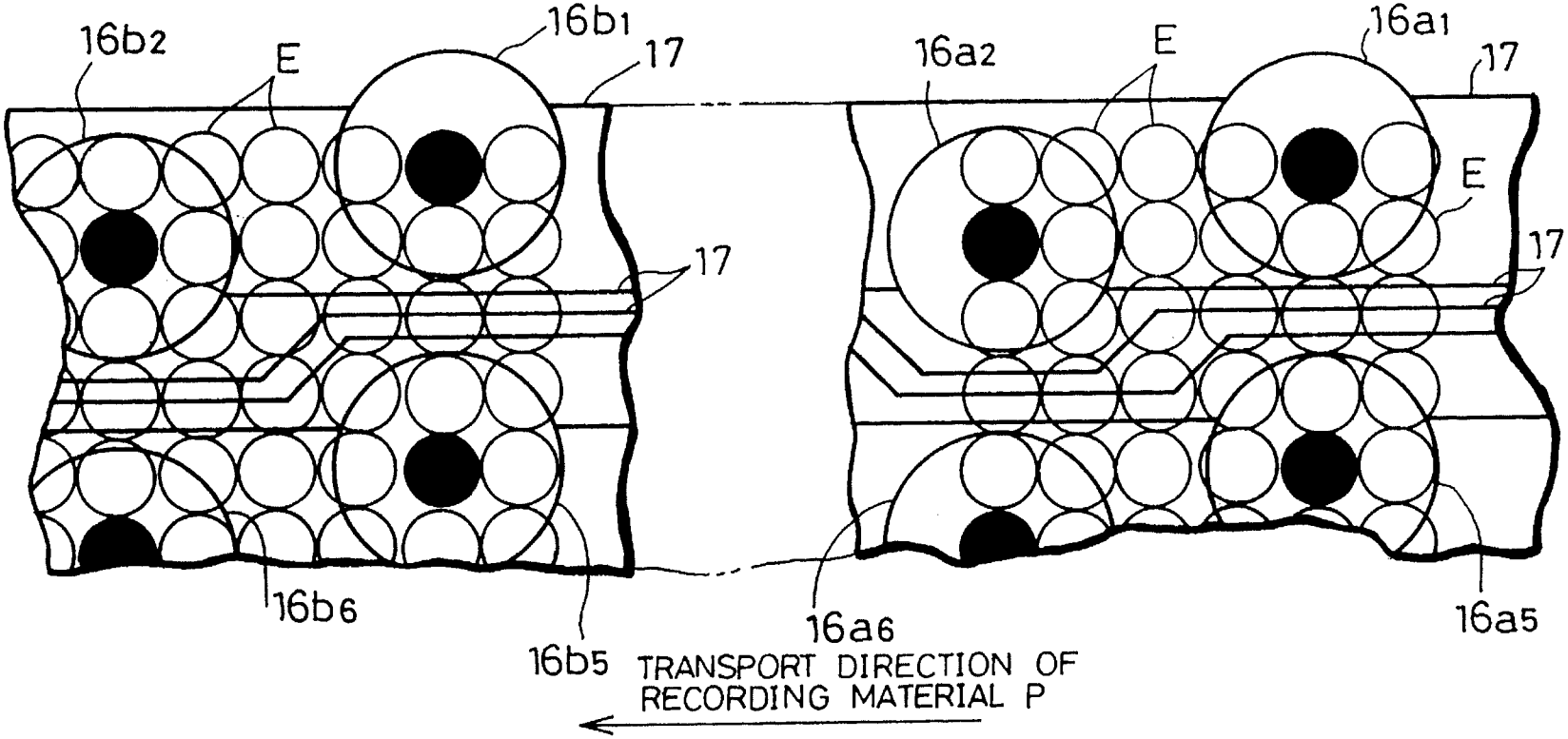
FIG. 21 is an explanatory view showing an example of pixels formed using the control electrode of FIG. 5.

First, the formation of one pixel by superimposing colors will be discussed with reference to FIG. 21. Here, 200 pixels E are formed per inch. In this case, pixels E are formed at an interval of 0.127 mm on the recording paper P. In order to print the pixels E on the recording paper P without space, it is necessary to make the diameter of each pixel E around 0.2 mm. Consequently, the opening section in the control electrode 16, i.e., the diameter of the toner passing hole 15 is larger than the diameter of the pixel E. In this embodiment, the diameter of the toner passing hole 15 for the black toner and the diameter of the toner passing hole 15 for other colors are made 0.3 mm and 0.35 mm, respectively, in order to produce the pixel E with a diameter of 0.2 mm on the recording paper P.

The recording paper P is transported from a yellow toner image forming position to a black toner image forming position during printing. For example, when a predetermined section of the recording paper P is located below the control electrode $\mathbf{16}a_1$ corresponding to yellow as shown in FIG. 21, if the print voltage Vb is applied to the control electrode $\mathbf{16}a_1$ and if the back electrode 14*a* is selected, a yellow dot with a diameter of 0.2 mm is formed on a position of the recording paper P corresponding to the control electrode $\mathbf{16}a_1$. In this case, the dots are formed in all portions of the recording paper P, which correspond to the yellow control electrodes 16 to which the print voltage Vb was applied.

The control electrodes 16 and the toner passing holes 15 belonging to one development roller 11*e* are arranged so that four of them are aligned in the transport direction of the recording paper P with a center distance of 0.508 mm. In the period during which the recording paper P moves one pixel distance (0.127 mm) in the transport direction, the back electrodes 14*a* to 14*d* corresponding to the respective colors are successively selected and dots of the respective colors are sequentially printed. When the recording paper P moves 0.508 mm forward, dots of the respective colors are produced in a width of 0.508 mm in the transport direction of the recording paper P along the line of the control electrodes 16. Subsequently, when the recording paper P moves 2.032 mm forward, lines of dots are connected to each other on a line orthogonal to the transport direction of the recording paper P. Such a rearrangement of data for printing is performed by the data converting circuit 59.

A group of the control electrodes 16 corresponds to one color. Adjacent groups of the control electrodes 16, for example, 16*a* and 16*b*, are disposed with a center distance of 34.04 mm. Therefore, when the recording paper P moves 34.04 mm forward, for example, a line of yellow toner dots on the recording paper P reaches below a group of the magenta control electrodes 16*b*. At this time, when the back electrode 14*b* is selected and the print voltage Vb is applied to the control electrode 16*b*, a magenta toner image is formed over the yellow toner image. Similarly, when the recording paper P moves 34.04 mm forward from this position, a cyan toner image is formed over the magenta toner image. When the recording paper P further moves 34.04 mm forward, a black toner image is formed over the cyan toner image. Superimposing of corresponding toner images of different colors can be performed by delaying the image signals of the respective colors by a time required for the movement of the recording paper P from one control electrode 16 corresponding to a predetermined color to an adjacent control electrode 16 corresponding to a different color by the buffers 55 to 57, and by transferring the delayed signal to the control-electrode voltage switching section 60.

Figure 22:
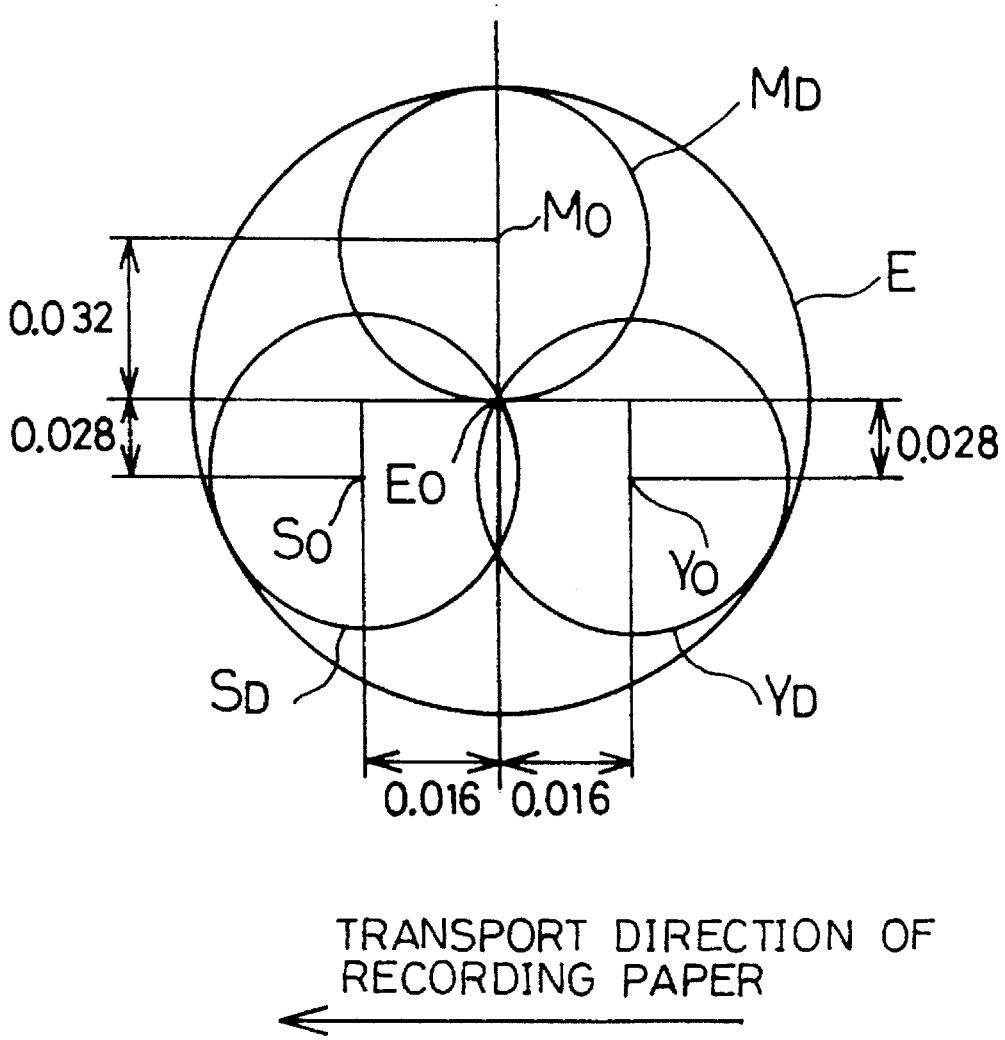
FIG. 22 is an explanatory view showing another example of pixels with respect to the example shown in FIG. 21.

Referring now to FIG. 22, the following description discusses a method for exhibiting the color of one pixel by forming dots of the respective colors in different locations. In this method, one pixel is printed as a collection of dots whose center points are positioned in different locations from each other. More specifically, as illustrated in FIG. 22, when one pixel is formed within a circular area with a diameter of 0.127 mm, for example, dots $Y_D$, $M_D$, $S_D$ corresponding to yellow, magenta and cyan, respectively, are formed within the area of a pixel E so that the center points thereof are positioned in different locations. Eo in FIG. 22 indicates the center of the pixel E.

In order to perform printing in the manner mentioned above, the control electrodes 16 and the toner passing holes 15 corresponding to yellow, magenta, and cyan are formed as follows. For example, the center Yo of the yellow dot is shifted by 0.016 mm from the center Eo of the pixel toward a direction opposite to the transport direction of the recording paper P and also shifted by 0.028 mm in a direction orthogonal to the transport direction. The center Mo of the magenta dot is shifted by 0.032 mm toward the direction opposite to Yo, i.e., in a direction orthogonal to the transport direction. The center So of the cyan dot is shifted by 0.016 mm from the center Eo toward the same direction as the transport direction of the recording paper P and also shifted by 0.028 mm toward the same direction as Yo, i.e., in a direction orthogonal to the transport direction. The overlapped section of the dots of three colors, $Y_D$, $M_D$, $S_D$, produces a black dot. However, it is also possible to independently produce a block dot within the pixel E without producing the overlapped section.

In this structure, since the overlapped section of dots is very small, it is possible to prevent such a problem that the superimposed dots, i.e., the toner layer, corrupts and increases the pixel size. Thus, this structure is superior over the above-mentioned method for forming a pixel by substantially superimposing dots. Moreover, since the overlapped section of dots is very small, it is possible to obtain a clear image without turbidity.

In the above-mentioned example, the dots of the respective colors partly overlap each other. However, if the control electrodes 16 and the toner passing holes 15 are further shifted so that the dots are completely separated from each other, the clearness of the image can be improved. The area of the overlapped section is adjustable by adjusting the print voltage Vb to be applied to the control electrodes 16 and the diameter of the toner beam.

In addition, in this color image forming apparatus, the driver IC 62 for constructing the control-electrode voltage switching section 60 is mounted on the driver substrate 12, and each high-voltage circuit for suppling a control voltage is connected to the driver IC 62 on the driver substrate 12. Thus, the high-voltage circuits are concentrated on the driver substrate 12. It is therefore possible to separate the high-voltage circuits from other control circuits, i.e., low-voltage circuits of the color image forming apparatus, thereby preventing the high-voltage circuits from affecting the low voltage circuits. This arrangement can reduce faulty operations and defects of the apparatus and improve the reliability of the apparatus.

In this embodiment, the recording paper P is continuously transported through the sections between the control electrodes 16 and the back electrodes 14. However, the present invention is not limited by this structure. For example, the recording paper P can be suitably stopped between the control electrodes 16 and the back electrodes 14 by controlling the suction belt 21. It is also possible to employ the structure shown in FIG. 2 in which the transport distance between the fuser 6 and an end position capable of performing printing on the recording paper P (hereinafter referred to as a printable end position) located between the control electrodes 16 and back electrode 14 corresponding to the toner tank 11*d* nearest to the fuser 6 is longer than the length of the recording paper P in the transport direction. This structure can decrease the capacity of each memory means disposed in the transmission path of image signals and reduce the cost.

More specifically, when continuously transporting the recording paper P between the control electrodes 16 and the back electrodes 14, it is necessary to continuously output image signals by the V-RAMs 54*a* to 54*d* shown in FIG. 7, for example. Accordingly, memories capable of storing a large volume of image data are required, resulting in an increase in the cost.

On the other hand, if the recording paper P is arranged to be freely stoppable between the control electrodes 16 and the back electrodes 14, it is possible to perform imaging while repeatedly executing storing and reading of the image signals in/from the V-RAMs 54*a* to 54*d*. In this case, low-cost small capacity memories can be used as the V-RAMs 54*a* to 54*d*. In the state in which the transport of the recording paper P is stopped, if the recording paper is nipped in the fuser 6 for a long time, the recording paper P tends to fade, warp and be creased by the heat of the heat roller 8. In order to solve such problems, if the length of the transport path of the recording paper P between the printable end position and the fuser 6 is made longer than the length of the recording paper P in the transport direction, it is possible to prevent the recording paper P from being nipped in the fuser 6 when the transport of the recording paper P is stopped.

For instance, the recording paper P may be suitably stopped as mentioned above by intermittently activating the suction belt 21. For example, stopping and activating the suction belt 21 are controlled by the structure in which the engine controller section 52 judges a shortage of image information read from the V-RAMs 54*a* to 54*d* and suitably controls the transporting means.

Figure 23:
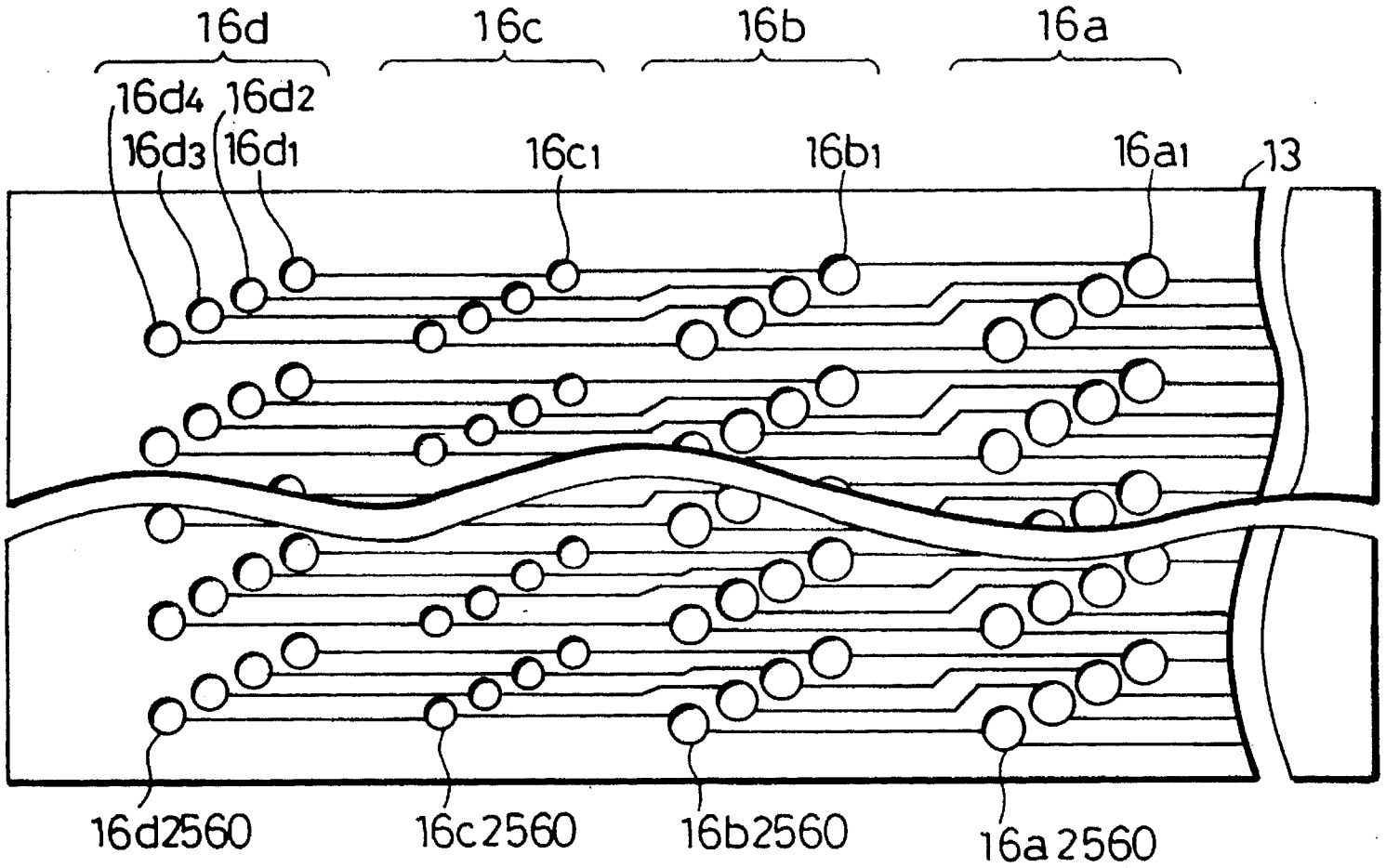
FIG. 23 is an explanatory view showing another example of the control electrode of FIG. 5.

In this embodiment, the toner passing holes 15 have the same diameter. However, for example, as illustrated in FIG. 23, the diameter of each toner passing hole 15 may be varied depending on the color of toner. In this structure, the diameter of the toner passing hole 15 corresponding to the yellow control electrode 16*a* is 270 μm. The diameter of the toner passing hole 15 corresponding to the magenta control electrode 16*b* is 250 μm. The diameter of the toner passing hole 15 corresponding to the cyan control electrode 16*c* is 180 μm. The diameter of the toner passing hole 15 corresponding to the black control electrode 16*d* is 200 μm. This structure achieves faithful reproduction of an image of mixed colors containing a large amount of yellow color which is generally difficult to be reproduced.

Moreover, as described above, the amount of toner of each color to be supplied to the image is adjustable by adjusting the diameter of the toner passing hole 15. However, in order to satisfactorily reproduce a color image, it is necessary to set at least the applied voltage to the control electrode 16 or the applied voltage to the back electrode 14 according to the diameter of the toner passing hole 15 and suitably control the amount of toner passing through the toner passing hole 15. It is therefore necessary to arrange at least the control-electrode power source 68 or the back-electrode power source 69 to output voltages of multiple levels corresponding to the diameters of the toner passing holes 15. It is also necessary to switch the output according to the selected control electrode 16 and back electrode 14.

For example, the print voltage Vb to be applied according to the diameter of the toner passing hole 15 is −80 V for the yellow control electrode 16*a*, −70 V for the magenta control electrode 16*b*, −30 V for the cyan control electrode 16*c*, and −50 V for the black control electrode 16*d*.

In this color image forming apparatus, the control-electrode power source 68 may be arranged to be capable of adjusting the print voltage Vb, for example, capable of changing the set value based on an input operation to the operation panel section so that the engine controller section 52 controls the print voltage Vb for the color of toner in printing. In this structure, it is possible to freely adjust the density and diameter of dots of each color, and obtain a satisfactory color image.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color image forming apparatus comprising:

toner carriers, aligned in a transport direction of recording paper in a recording paper passing section, for carrying toner charged in a predetermined polarity, one toner carrier being provided for each toner color;

an insulating substrate including a plurality of toner passing holes having a diameter which allows passage of the toner, said insulating substrate being disposed opposite to said toner carriers, said toner passing holes being formed in locations facing said toner carriers;

control electrodes mounted on positions corresponding to said toner passing holes, respectively, on said insulating substrate;

back electrodes disposed opposite to said insulating substrate with a clearance therebetween, said clearance functioning as said recording paper passing section;

recording paper transporting means for transporting said recording paper through said recording paper passing section;

back-electrode voltage applying means for applying to said back electrodes a voltage of an opposite polarity to the toner to produce an electric field which causes the toner carried by said toner carriers to pass through said toner passing holes and move toward said back electrodes; and control-electrode voltage applying means for producing an electric field which controls a movement of the toner from said toner carriers toward said back electrodes through said toner passing holes by selectively applying to said control electrodes a control voltage which varies according to an image signal, said control voltage having a substantially same polarity as toner charged to a predetermined polarity both when the toner is allowed to pass through said toner passing holes and when the toner is not allowed to pass through said toner passing holes to always prevent the toner from adhering to said control electrodes.

2. The color image forming apparatus according to claim 1, wherein said control-electrode voltage applying means selectively applies either a first control voltage or a second control voltage to said control electrodes, said first control voltage allowing passage of the toner through said toner passing holes when the voltage is applied to said back electrodes by said back-electrode voltage applying means, said second control voltage preventing passage of the toner through said toner passing holes even when the voltage is applied to said back electrodes by said back-electrode voltage applying means, said first and second control voltages exhibiting the same polarity as a polarity of the toner.

3. The color image forming apparatus according to claim 2, wherein said control-electrode voltage applying means includes switching means for selectively switching the voltage to be applied to said control electrodes between said first control voltage and said second control voltage.

4. The color image forming apparatus according to claim 1, wherein one back electrode is provided for each toner color in a position facing said toner passing holes through which the toner of one color passes, and said back-electrode voltage applying means includes:

back-electrode power source for outputting a voltage of an opposite polarity to the toner; and switching means for selectively switching over one of said back electrodes corresponding to respective colors to the other back electrode to which the voltage of said back-electrode power source is to be applied.

5. The color image forming apparatus according to claim 1, wherein said toner passing holes are arranged at substantially equal intervals in a direction orthogonal to the transport direction of said recording paper and in rows parallel to the transport direction of said recording paper with respect to each color, and said control electrodes of respective colors which are installed on the periphery of said toner passing holes of the respective colors producing one pixel aligned in the transport direction of said recording paper, are electrically connected to each other.

6. The color image forming apparatus according to claim 1, wherein said toner carriers are rollers which rotate while carrying the toner on a surface thereof.

7. The color image forming apparatus according to claim 1, wherein said control-electrode voltage applying means includes means for adjusting a voltage for moving the toner through said toner passing holes toward said back electrodes.

8. The color image forming apparatus according to claim 1, wherein a diameter of each toner passing hole is set according to a color of the toner carried by said toner carrier to which said toner passing hole belongs, and at least either said control-electrode voltage applying means or said back-electrode voltage applying means sets an output voltage according to the diameter of said toner passing hole.

9. The color image forming apparatus according to claim 1, wherein said control-electrode voltage applying means includes:

control signal generating means for generating a control signal corresponding to each control electrode from an image signal; and signal converting means for converting a control signal output by said control signal generating means into a predetermined control voltage.

10. The color image forming apparatus according to claim 9, wherein said control-electrode voltage applying means is mounted on said insulating substrate so as to be separated from other low voltage circuits.

11. The color image forming apparatus according to claim 9, wherein said control signal generating means includes:

memory means for storing image signals of respective colors separately from each other;

signal delay means for causing the image signals of the respective colors read from said memory means to have delays in outputting said image signals;

selecting means for successively selecting one of the image signals of the respective colors output from said signal delay means; and signal pattern converting means for converting the image signal of a color selected by said selecting means into a signal pattern corresponding to an alignment of said control electrodes and toner passing holes.

12. The color image forming apparatus according to claim 9, wherein said signal converting means includes:

first control voltage supply means for outputting a first voltage which allows passage of the toner through said toner passing holes when the voltage is applied to said back electrodes by said back-electrode voltage applying means;

second control voltage supply means for outputting a second voltage which prevents passage of the toner through said toner passing holes even when the voltage is applied to said back electrodes by said back-electrode voltage applying means; and switching means for selectively switching the voltage to be applied to said control electrodes between said first control voltage and said second control voltage according to the control signal.

13. The color image forming apparatus according to claim 1, wherein said control electrodes are mounted on a surface of said insulating substrate, which faces said toner carriers.

14. The color image forming apparatus according to claim 1, wherein a semiconducting layer is formed on top surfaces of said back electrodes.

15. The color image forming apparatus according to claim 14, wherein a resistance of said semiconducting layer is set within a range of from $10^7$ to $10^9$ Ω.

16. The color image forming apparatus according to claim 1, wherein said recording paper transporting means includes a transport guide plate for guiding transport of said recording paper by supporting a lower surface of said recording paper passing through said recording paper passing section, said back electrodes are buried in said transport guide plate so as to have an even top surface, and a semiconducting layer is formed on the top surface of said transport guide plate and said back electrodes.

17. The color image forming apparatus according to claim 1, further comprising fusing means, disposed on a downstream side of the control electrode located in a most downstream position in the transport direction of said recording paper, for heating the toner on said recording paper and fixing the toner to said recording paper, wherein a length of a recording paper transport path between said fusing means and said control electrode located on the most downstream position is longer than a length of said recording paper in the transport direction, and said recording paper transporting means is capable of stopping said recording paper in said recording paper passing section.

18. A color image forming apparatus comprising:

toner carriers, aligned in a transport direction of recording paper in a recording paper passing section, for carrying toner charged in a predetermined polarity, one toner carrier being provided for each toner color;

an insulating substrate including a plurality of toner passing holes having a diameter which allows passage of the toner, said insulating substrate being disposed opposite to said toner carriers, said toner passing holes being formed in locations facing said toner carriers;

control electrodes mounted on positions corresponding to said toner passing holes, respectively, on said insulating substrate;

back electrodes disposed opposite to said insulating substrate with a clearance therebetween, said clearance functioning as said recording paper passing section;

recording paper transporting means for transporting said recording paper through said recording paper passing section;

back-electrode voltage applying means for applying to said back electrodes a voltage of an opposite polarity to the toner to produce an electric field which causes the toner carried by said toner carriers to pass through said toner passing holes and move toward said back electrodes;

control-electrode voltage applying means for producing an electric field which controls a movement of the toner from said toner carriers toward said back electrodes through said toner passing holes by selectively applying to said control electrodes a voltage according to an image signal; and toner-carrier voltage applying means for applying to said toner carriers a voltage of the same polarity as the toner when the voltage of the opposite polarity to the toner is applied to said back electrodes by said back-electrode voltage applying means, and for applying to said toner carriers a voltage of the opposite polarity to the toner when the voltage is not applied to said back electrodes.

19. The color image forming apparatus according to claim 18, wherein said toner passing holes are arranged at substantially equal intervals in a direction orthogonal to the transport direction of said recording paper and in rows parallel to the transport direction of said recording paper with respect to each color, and said control electrodes of respective colors which are installed on the periphery of said toner passing holes of the respective colors producing one pixel aligned in the transport direction of said recording paper, are electrically connected to each other.

20. The color image forming apparatus according to claim 18, wherein said plurality of toner passing holes formed on said insulating substrate are arranged so that center positions of dots of respective colors producing one pixel differ from each other.

21. The color image forming apparatus according to claim 20, wherein said control electrodes of respective colors which are installed on the periphery of said toner passing holes of the respective colors producing one pixel aligned in the transport direction of said recording paper, are electrically connected to each other.

22. The image forming apparatus as set forth in claim 20, wherein said toner passing hole belonging to one of said toner carrier for forming a first color dot and said toner passing hole belonging to the other toner carrier for forming a second color dot which produces one pixel together with the first color dot are arranged on positions shifted from a straight line which is parallel to the transport direction of said recording paper in a direction orthogonal to the straight line.

23. The image forming apparatus as set forth in claim 20, wherein said toner passing holes belonging to different toner carriers for forming dots of respective colors which produce one pixel together are arranged at uneven intervals in the transport direction of said recording paper.

24. The color image forming apparatus according to claim 18, wherein said control electrodes of respective colors, which are installed on the periphery of said toner passing holes of the respective colors producing one pixel aligned in the transport direction of said recording paper, are electrically connected to each other.

25. A color image forming apparatus comprising:

toner carriers, aligned in a transport direction of recording paper in a recoding paper passing section, for carrying toner charged in a predetermined polarity, one toner carrier being provided for each toner color;

an insulating substrate including a plurality of toner passing holes having a diameter which allows passage of the toner, said insulating substrate being disposed opposite to said toner carriers, said toner passing holes being formed in locations facing said toner carriers;

control electrodes mounted on positions corresponding to said toner passing holes, respectively, on said insulating substrate;

back electrodes disposed opposite to said insulating substrate with a clearance therebetween, said clearance functioning as said recording paper passing section;

recording paper transporting means for transporting said recording paper through said recording paper passing section;

back-electrode voltage applying means for applying to said back electrodes a voltage of an opposite polarity to the toner to produce an electric field which causes the toner carried by said toner carriers to pass through said toner passing holes and move toward said back electrodes;

control-electrode voltage applying means for selectively applying either a first control voltage whose polarity is opposite to the toner or a second control voltage whose polarity is the same as the toner to said control electrodes according to an image signal, said first control voltage allowing passage of the toner through said toner passing holes when the voltage is applied to said back electrodes by said back-electrode voltage applying means, said second control voltage preventing passage of the toner through said toner passing holes even when the voltage is applied to said back electrodes by said back electrode voltage applying means; and toner-carrier voltage applying means for applying to said toner carriers a voltage which is of an opposite polarity to the toner and higher than said first control voltage in non-printing during which the voltage is not applied to said back electrodes by said back-electrode voltage applying means.

26. The color image forming apparatus according to claim 25, wherein said toner passing holes are arranged at substantially equal intervals in a direction orthogonal to the transport direction of said recording paper and in rows parallel to the transport direction of said recording paper with respect to each color, and said control electrodes of respective colors which are installed on the periphery of said toner passing holes of the respective colors producing one pixel aligned in the transport direction of said recording paper, are electrically connected to each other.

27. The color image forming apparatus according to claim 25, wherein said plurality of toner passing holes formed on said insulating substrate are arranged so that center positions of dots of respective colors producing one pixel differ from each other.

28. The color image forming apparatus according to claim 27, wherein said control electrodes of respective colors, which are installed on the periphery of said toner passing holes of the respective colors producing one pixel aligned in the transport direction of said recording paper, are electrically connected to each other.

29. The color image forming apparatus according to claim 27, wherein said toner passing hole belonging to one of said toner carrier for forming a first color dot and said toner passing hole belonging to the other tone carrier for forming a second color dot which produces one pixel together with the first color dot are arranged on positions shifted from a straight line which is parallel to the transport direction of said recording paper in a direction orthogonal to the straight line.

30. The color image forming apparatus according to claim 27, wherein said toner passing holes belonging to different tone carriers for forming dots of respective colors which produce one pixel together are arranged at uneven intervals in the transport direction of said recording paper.

31. The color image forming apparatus according to claim 25, wherein said control electrodes of respective colors, which are installed on the periphery of said toner passing holes of the respective colors producing one pixel aligned in the transport direction of said recording paper, are electrically connected to each other.

* * * * *